US010514644B2

(12) United States Patent
Matsuzaki

(10) Patent No.: US 10,514,644 B2
(45) Date of Patent: Dec. 24, 2019

(54) IMAGE FORMING APPARATUS

(71) Applicant: Oki Data Corporation, Tokyo (JP)

(72) Inventor: Yoshiki Matsuzaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/919,845

(22) Filed: Mar. 13, 2018

(65) Prior Publication Data

US 2018/0284674 A1 Oct. 4, 2018

(30) Foreign Application Priority Data

Mar. 28, 2017 (JP) ..... 2017-062880

(51) Int. Cl.
*G03G 15/00* (2006.01)

(52) U.S. Cl.
CPC ..... *G03G 15/5033* (2013.01); *G03G 15/5016* (2013.01); *G03G 15/55* (2013.01); *G03G 15/5087* (2013.01)

(58) Field of Classification Search
CPC ..... G03G 15/5033; G03G 15/161; G03G 15/5016; G03G 15/55; G03G 15/5087
See application file for complete search history.

(56) References Cited

U.S. PATENT DOCUMENTS 8,630,560 B2 * 1/2014 Goto ..... G03G 15/0194 399/49

FOREIGN PATENT DOCUMENTS

JP 2017-019107 A 1/2017

* cited by examiner

*Primary Examiner* — Hoang X Ngo
(74) *Attorney, Agent, or Firm* — Muncy, Geissler, Olds & Lowe, P.C.

(57) ABSTRACT

An image forming apparatus includes a carrying part, a transfer member that transfers a developer image, a first detection part that detects an adhering object that adheres to the carrying member, generating a first detection result, and a control part that performs a carrying control in which the carrying operation of the developer image by the carrying member is controlled based on the first detection result by the first detection part.

16 Claims, 16 Drawing Sheets

IMAGE FORMING APPARATUS

TECHNICAL FIELD

This invention relates to an image forming apparatus that forms an image on a recording medium.

BACKGROUND

As the recording medium, there is so-called a label sheet where labels are arranged and temporarily attached to a long backing sheet. Disclosed in Patent Document 1 is an image forming apparatus that forms an image on a label sheet.

RELATED ART

[Patent Doc. 1] JP Laid-Open Patent Application Publication 2017-19107

In an image forming apparatus that forms an image on a label sheet, while the label sheet is being carried, for example, a label waste surrounding the labels (hereafter also called an unwanted object) can peel off inside the image forming apparatus. It is desired that the image forming apparatus would not easily fail even in such a case as this.

It is desired to offer an image forming apparatus that can make failures hard to occur.

SUMMARY

An image forming apparatus disclosed in the application comprises a carrying part having a carrying member that holds a developer image and carries the developer image through a carrying operation along a carrying path for the developer image, a transfer member that is disposed opposing the carrying member in a prescribed position and transfers the developer image held by the carrying member to a recording medium, a first detection part that is disposed in a downstream side with respect to the prescribed position of the transfer member in the carrying path of the developer image, which is carried by the carrying member, and detects an adhering object that adheres to the carrying member, generating a first detection result, and a control part that performs a carrying control in which the carrying operation of the developer image by the carrying member is controlled based on the first detection result by the first detection part.

Another image forming apparatus disclosed in the application comprises: a development part that develops a latent image, which is created from image data to be printed on a recording medium, with a developer so that a development image is generated by the developer adhering to the latent image, a carrying part that has a carrying member of which an outer surface circulates along a carrying path to carry the developer image from the development part, the development image of the development part being designed to be placed within a designated printable section of the carrying member, a transfer member that is disposed opposing the carrying member and sandwiching the carrying path with the carrying member in a prescribed position such that a nip section is created between the transfer member and the carrying part at the prescribed position, and transfers the developer image held in the designated printable section of the carrying member to the recording medium that is conveyed along a medium conveyance path, a first detection part that is disposed in a downstream side with respect to the nip section of the transfer member in the carrying path, and obtains a post-transfer image of the designated printable section, the post-transfer image being composed with pixel values, a second detection part that is disposed in an upstream side with respect to the nip section of the transfer member in the carrying path, and obtains a pre-transfer image of the designated printable section, the pre-transfer image being composed with pixel values, a control part that controls a development operation of the development part and a carrying operation of the carrying part. Wherein the control part determines a development region (W) of the pre-transfer image that is shaped in correspondence with an area where the developer is held on the carrying member, and the control part determines a processing target region of the post-transfer image that is calculated by deducting the development region of the pre-transfer image from the post-transfer image, a remaining region of the post-transfer image that is a remaining of the post-transfer image other than the processing target region, and the control part stops the carrying operation of the carrying part when a predetermined percentage of the processing target region has pixel values that differ by more than a predetermined threshold value from the remaining region.

According to an image forming apparatus in an embodiment of this invention, in the downstream side of a position where a carrying member and a transfer member oppose each other in a carrying path of a developer image by the carrying member, a first detection part that detects an adhering object adhering to the carrying member is installed, making a failure hard to occur.

DETAILED DESCRIPTIONS OF PREFERRED EMBODIMENTS

Below, embodiments of this invention are explained in detail referring to drawings. Note that the explanations are given in the following order.

1. First Embodiment
2. Second Embodiment

1. First Embodiment

Configuration Example

Figure 1:
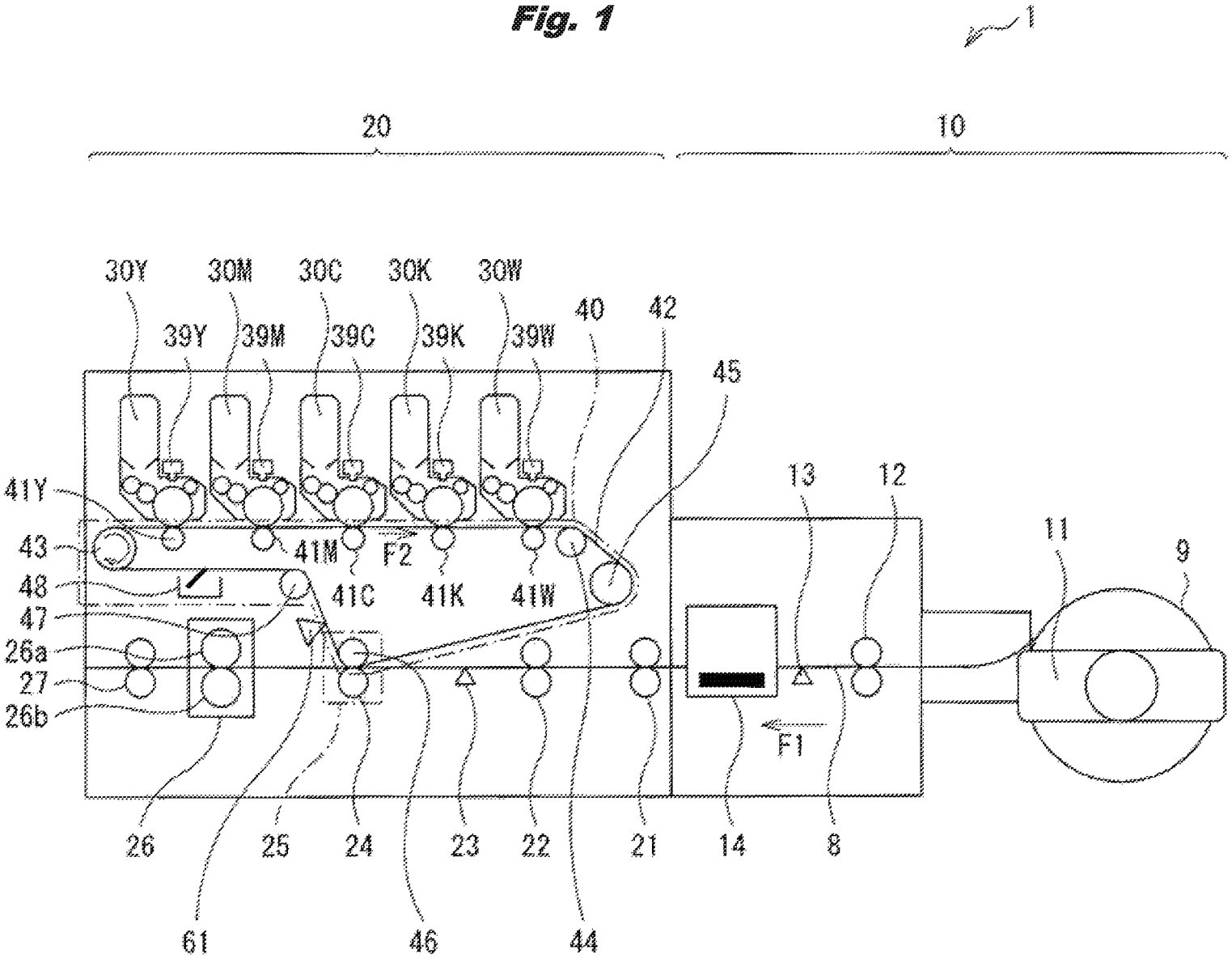
FIG. 1 is an explanatory diagram showing a configuration example of an image forming apparatus according to a first embodiment.

Shown in FIG. 1 is a configuration example of an image forming apparatus (image forming apparatus 1) of the first embodiment of this invention. The image forming apparatus 1 is, for example, a printer that forms an image using the electrophotographic system on so-called a label sheet. The image forming apparatus 1 is provided with a medium supply part 10 and an image forming part 20.

The medium supply part 10 extracts a recording medium 9 from a wound roll of the recording medium 9 and supplies it to the image forming part 20.

Figure 2:
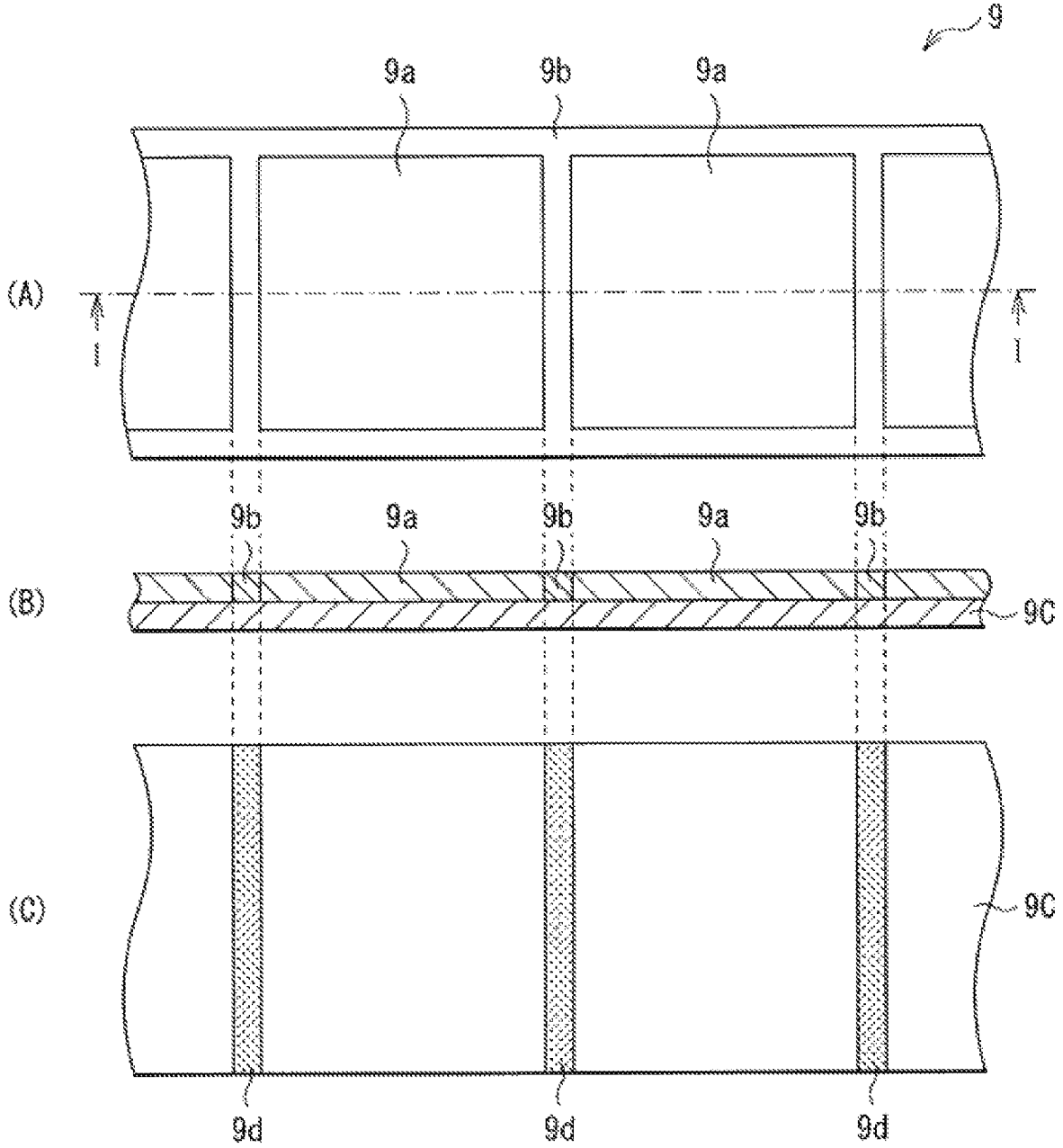
FIG. 2 is an explanatory diagram showing a configuration example of a recording medium shown in FIG. 1.

Shown in FIG. 2 is a configuration example of the recording medium 9, where (A) shows the front face (label face) of the recording medium 9, (B) shows a cross section I-I viewed in the direction of arrows in FIG. 2A, and (C) shows the back face of the recording medium 9. The recording medium 9 has multiple labels 9*a* and a backing sheet 9*c*. The multiple labels 9*a* are arranged in the longitudinal direction of the recording medium 9 on the front face (label face) of the recording medium 9 and temporarily attached to the backing sheet 9*c*. Also, around the labels 9*a* there is an unwanted object 9*b* that is a label waste, and this unwanted object 9*b* is also temporarily attached to the backing sheet 9*c*. On the back face of the backing sheet 9*c*, markers 9*d* are printed. These markers 9*d* are, in this example, formed in positions corresponding to spaces between neighboring labels 9*a* in the arrangement direction of the labels 9*a* (the horizontal direction in FIG. 2).

The medium supply part 10 (FIG. 1) has a medium fixing part 11, a carrying roller 12, a label sensor 13, and a cutting part 14. The carrying roller 12, the label sensor 13, and the cutting part 14 are disposed in this order in a carrying direction F1 of the recording medium 9 along a carrying path 8.

The medium fixing part 11 fixes the wound roll of the recording medium 9 in a rotatable manner centering on its axis. Thereby, the recording medium 9 is extracted from the roll by the roll rotating.

The carrying roller 12 is configured of a pair of rollers sandwiching the carrying path 8, and extracts the recording medium 9 from the roll and carries it along the carrying path 8.

The label sensor 13 detects the position of each label 9*a* of the recording medium 9. Specifically, for example, the label sensor 13 is configured using a reflection-type sensor, and detects the position of the label 9*a* by detecting the markers 9*d* based on reflected light when light is radiated onto the back face of the recording medium 9. Then, based on this detection result of the label sensor 13, the image forming apparatus 1 determines the position to cut the recording medium 9 by the cutting part 14.

The cutting part 14 is a member that cuts the recording medium 9. Based on the detection result of the label sensor 13, the cutting part 14 cuts the recording medium 9 by a prescribed number of labels 9*a* specified by the user as one unit for example.

The image forming part 20 forms images on the label face of the recording medium 9 supplied from the medium supply part 10. The image forming part 20 has five image forming units 30 (image forming units 30Y, 30M, 30C, 30K, and 30W), five exposure parts 39 (exposure parts 39Y, 39M, 39C, 39K, and 39W), a belt unit 40, and a line sensor 61.

Each of the five image forming units 30 forms a toner image. Specifically, the image forming unit 30Y forms a yellow toner image, the image forming unit 30M forms a magenta toner image, the image forming unit 30C forms a cyan toner image, the image forming unit 30K forms a black toner image, and the image forming unit 30W forms a white toner image. Each of the image forming units 30 is configured in a detachable manner. The image forming units 30Y, 30M, 30C, 30K, and 30W are disposed in this order in a carrying direction F2 of a transfer belt 42 (mentioned below) of the belt unit 40.

The five exposure parts 39 are members that radiate light onto photosensitive bodies 31 (mentioned below) of the five image forming units 30, respectively. Specifically, the exposure part 39Y radiates light onto the photosensitive body 31 of the image forming unit 30Y, the exposure part 39M radiates light onto the photosensitive body 31 of the image forming unit 30M, the exposure part 39C radiates light onto the photosensitive body 31 of the image forming unit 30C, the exposure part 39K radiates light onto the photosensitive body 31 of the image forming unit 30K, and the exposure part 39W radiates light onto the photosensitive body 31 of the image forming unit 30W. Thereby, these photosensitive bodies 31 are exposed by their respective exposure parts 39. As the result, an electrostatic latent image is formed on the surface of each photosensitive body 31.

Figure 3:
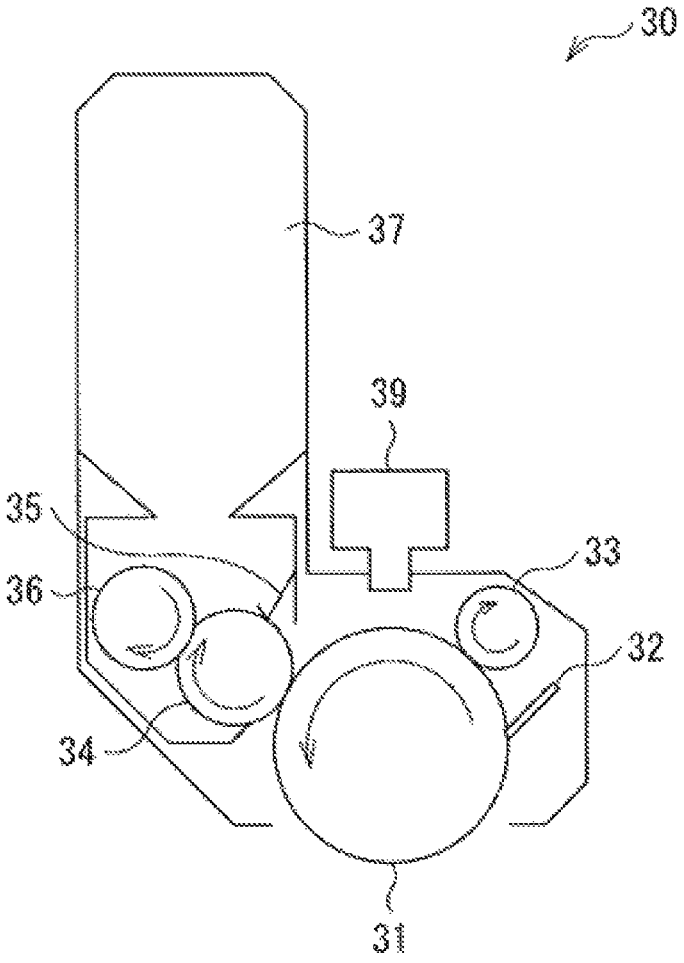
FIG. 3 is an explanatory view showing one configuration example of the image forming unit shown in FIG. 1.

Shown in FIG. 3 is a configuration example of each image forming unit 30. The image forming unit 30 has the photosensitive body 31, a cleaning blade 32, a charging roller 33, a development roller 34, a development blade 35, a supply roller 36, and a toner accommodation part 37. Note that the exposure part 39 is also drawn in this FIG. 3 for convenience of explanation.

The photosensitive body 31 is a member that holds an electrostatic latent image on its surface (surface layer part). The photosensitive body 31 rotates counterclockwise in this example by a power transmitted from a photosensitive body motor (not shown). The photosensitive body 31 is charged by the charging roller 33 and exposed by the exposure part 39. Thereby, an electrostatic latent image is formed on the surface of the photosensitive body 31. Then, by a toner being supplied by the development roller 34, a toner image corresponding to the electrostatic latent image is formed (developed) on the photosensitive body 31.

The cleaning blade 32 is a member that cleans the surface (surface layer part) of the photosensitive body 31 by scraping any remaining toner off. The cleaning blade 32 is disposed so as to be in counter-contact with the surface of the photosensitive body 31 (protruding in the opposite direction of the rotation direction of the photosensitive body 31) and also pressed onto the photosensitive body 31 by a prescribed pressing amount.

The charging roller 33 is a member that charges the surface (surface layer part) of the photosensitive body 31. The charging roller 33 is disposed so as to be in contact with the surface (circumferential face) of the photosensitive body 31 and pressed onto the photosensitive body 31 by a prescribed pressing amount. The charging roller 33 rotates clockwise in this example according to the rotation of the photosensitive body 31. A prescribed charging voltage is applied to the charging roller 33 by a voltage generation part 56 (mentioned below).

The development roller 34 is a member that holds the charged toner on its surface. The development roller 34 is disposed so as to be in contact with the surface (circumferential face) of the photosensitive body 31 and also pressed onto the photosensitive body 31 by a prescribed pressing amount. The development roller 34 rotates clockwise in this example by a power transmitted from the photosensitive body motor (not shown). A prescribed development voltage is applied to the development roller 34 by the voltage generation part 56 (mentioned below).

The development blade 35 is a member that forms a layer made of toner (toner layer) on the surface of this development roller 34 and also regulates (controls, adjusts) the thickness of the toner layer by being in contact with the surface of the development roller 34. The development blade 35 is, for example, a plate-shape elastic member made of stainless steel or the like bent in an L shape. The development blade 35 is disposed so that its bent part comes into contact with the surface of the development roller 34 and is pressed onto the development roller 34 by a prescribed pressing amount.

The supply roller 36 is a member that supplies a toner stored inside the toner accommodation part 37 to the development roller 34. The supply roller 36 is disposed so as to be in contact with the surface (circumferential face) of the development roller 34 and pressed onto the development roller 34 by a prescribed pressing amount. The supply roller 36 rotates clockwise in this example by a power transmitted from the photosensitive body motor (not shown). Thereby, a friction is generated between the surface of the supply roller 36 and the surface of the development roller 34, and the toner is charged by so-called friction charging. A prescribed supply voltage is applied to the supply roller 36 by the voltage generation part 56 (mentioned below).

The toner accommodation part 37 stores a toner. Specifically, the toner accommodation part 37 of the image forming unit 30Y stores yellow toner, the toner accommodation part 37 of the image forming unit 30M stores magenta toner, the toner accommodation part 37 of the image forming unit 30C stores cyan toner, the toner accommodation part 37 of the image forming unit 30K stores black toner, and the toner accommodation part 37 of the image forming unit 30W stores white toner.

By this configuration, the photosensitive body 31 is charged by the charging roller 33 and exposed by the exposure part 39 in the image forming unit 30. Thereby, an electrostatic latent image is formed on the surface of the photosensitive body 31. Also, the toner stored inside the toner accommodation part 37 is charged by the supply roller 36 and the development roller 34 and supplied to the photosensitive body 31. Thereby, a toner image corresponding to the electrostatic latent image is formed (developed) on the photosensitive body 31.

The belt unit 40 (FIG. 1) has five primary transfer rollers 41 (primary transfer rollers 41Y, 41M, 41C, 41K, and 41W), a transfer belt 42, a drive roller 43, idle rollers 44 and 45, a secondary transfer backup roller 46, an idle roller 47, and a cleaning device 48. This belt unit 40 is configured in a detachable manner.

The five primary transfer rollers 41 are members for electrostatically transferring the toner images formed by the five image forming units 30 onto the transfer target surface of the transfer belt 42, respectively. The primary transfer roller 41Y is disposed opposing the photosensitive body 31 of the image forming unit 30Y through the transfer belt 42, the primary transfer roller 41M is disposed opposing the photosensitive body 31 of the image forming unit 30M through the transfer belt 42, the primary transfer roller 41C is disposed opposing the photosensitive body 31 of the image forming unit 30C through the transfer belt 42, the primary transfer roller 41K is disposed opposing the photosensitive body 31 of the image forming unit 30K through the transfer belt 42, and the primary transfer roller 41W is disposed opposing the photosensitive body 31 of the image forming unit 30W through the transfer belt 42. A prescribed primary transfer voltage is applied to each of the primary transfer rollers 41 by the voltage generation part 56 (mentioned below). Thereby, the toner images formed by the image forming units are transferred (primary-transferred) onto the transfer target surface of the transfer belt 42 in the image forming apparatus 1.

The transfer belt 42 holds the toner images on the transfer target surface and carries the toner images to a secondary transfer part 25 (mentioned below). The transfer belt 42 is, for example, an endless elastic belt configured of a high-resistance semiconductive plastic film. The transfer belt 42 is stretched by the drive roller 43, the idle rollers 44 and 45, the secondary transfer backup roller 46, and the idle roller 47. Then, the transfer belt 42 is cyclically carried according to the rotation of the drive roller 43.

The drive roller 43 cyclically carries the transfer belt 42. In this example, the drive roller 43 is disposed in the upstream side of the five image forming units 30 in the carrying direction F2 of the transfer belt 42, and rotates clockwise in this example by a power transmitted from a transfer belt motor (not shown). Thereby, the drive roller 43 cyclically carries the transfer belt 42.

The idle rollers 44 and 45 rotate clockwise in this example following the cyclical carriage of the transfer belt 42. In this example, the idle roller 44 is disposed in the downstream side of the five image forming units 30, and the idle roller 45 is disposed in the downstream side of the idle roller 44 in the carrying direction F2 of the transfer belt 42.

The secondary transfer backup roller 46 rotates clockwise in this example following the cyclical carriage of the transfer belt 42. The secondary transfer backup roller 46 is disposed opposing the secondary transfer roller 24 through the carrying path 8 and the transfer belt 42. Together with the secondary transfer roller 24, the secondary transfer backup roller 46 configures the secondary transfer part 25.

The idle roller 47 is configured of a pair of rollers sandwiching the transfer belt 42, and rotates counterclockwise in this example following the cyclical carriage of the transfer belt 42. The idle roller 47 is disposed in the downstream side of the secondary transfer part 25 in the carrying direction F2 of the transfer belt 42.

The cleaning device 48 is a device that cleans the transfer belt 42 by scraping off any toner remaining on the transfer target surface of the transfer belt 42. Then, the scraped-off toner is accommodated in a container of the cleaning device 48.

The line sensor 61 has light-receiving elements disposed in a row, and images the transfer target surface of the transfer belt 42. The line sensor 61 is disposed in the downstream side of the secondary transfer part 25 and in the upstream side of the cleaning device 48 in the carrying direction F2 of the transfer belt 42.

The image forming part 20 further has carrying rollers 21 and 22, a label sensor 23, the secondary transfer roller 24, a fuser part 26, and an ejection roller 27.

The carrying roller 21 is configured of a pair of rollers sandwiching the carrying path 8, and carries the recording medium 9 supplied from the medium supply part 10 along the carrying path 8. The carrying roller 22 is configured of a pair of rollers sandwiching the carrying path 8, and carries the recording medium 9 carried by the carrying roller 21 toward the secondary transfer part 25 along the carrying path 8.

The label sensor 23 detects the position of each label 9*a* of the recording medium 9. Specifically, for example, the label sensor 23 is configured using a reflection-type sensor, and detects the position of the label 9*a* by detecting the markers 9*d* based on reflected light when light is radiated onto the back face of the recording medium 9. Then, based on this detection result of the label sensor 23, the image forming apparatus 1 adjusts the transfer position of the toner image on the recording medium 9.

The secondary transfer roller 24 is a member for transferring the toner images on the transfer target surface of the transfer belt 42 to the labels 9*a* of the recording medium 9. The secondary transfer roller 24 is disposed opposing the secondary backup roller 46 through the carrying path 8 and the transfer belt 42. Together with the secondary transfer backup roller 46, the secondary transfer roller 24 configures the secondary transfer part 25. A prescribed secondary transfer voltage is applied to the secondary transfer roller 24 by the voltage generation part 56 (mentioned below). Thereby, the toner images on the transfer target surface of the transfer belt 42 are transferred (secondary-transferred) to the labels 9*a* of the recording medium 9 in the image forming apparatus 1.

The fuser part 26 is a member that fuses the toner image transferred onto the recording medium 9 with the recording medium 9 by applying heat and a pressure to the recording medium 9. The fuser part 26 has a heat application roller 26*a* and a pressure application roller 26*b*. The heat application roller 26*a* comprises, for example, a heater such as a halogen lamp inside it, and is a member that applies heat to the toner on the recording medium 9. The pressure application roller 26*b* is disposed so as to form a pressure-contact part between it and the heat application roller 26*a*, and is a member that applies a pressure to the toner on the recording medium 9. Thereby, the toner on the recording medium 9 is heated, melted, and pressed in the fuser part 26. As the result, the toner image is fused onto the recording medium 9.

The ejection roller 27 is configured of a pair of rollers sandwiching the carrying path 8, and is a member that ejects the recording medium 9 to the outside of the image forming apparatus 1.

Figure 4:
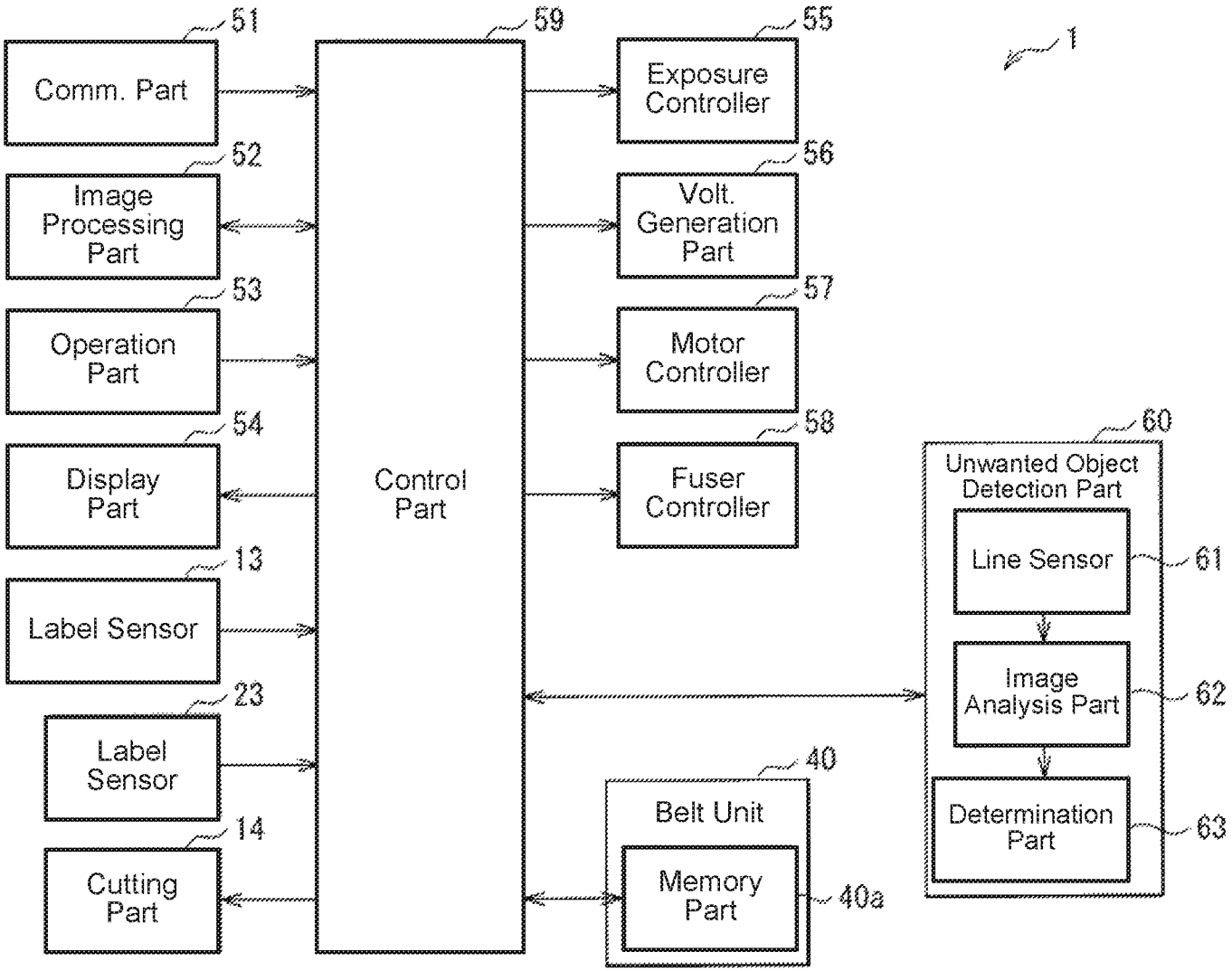
FIG. 4 is a block diagram illustrating a configuration example of the image forming apparatus shown in FIG. 1.

Shown in FIG. 4 is an example of the control mechanism in the image forming apparatus 1. The image forming apparatus 1 has a communication part 51, an image processing part 52, an operation part 53, a display part 54, an exposure controller 55, the voltage generation part 56, a motor controller 57, a fuser controller 58, an unwanted object detection part 60, and a control part 59.

The communication part 51 performs communication using LAN (Local Area Network), USB (Universal Serial Bus), Centronics, or the like for example, and receives print data sent from an unshown host computer for example. The image processing part 52 generates image data (bit map data) based on the print data received by the communication part 51.

The operation part 53 accepts a user's operation, and is configured using various kinds of buttons, a touch panel, and/or the like for example. The display part 54 displays the operation status etc. of the image forming apparatus 1, and is configured using a liquid-crystal display and/or various kinds of indicators for example.

The exposure controller 55 controls the operations of the five exposure parts 39 using the image data generated by the image processing part 52 based on an instruction from the control part 59. Based on an instruction from the control part 59, the voltage generation part 56 generates various voltages (the charging voltage, the development voltage, the supply voltage, the primary transfer voltage, the secondary transfer voltage, etc.) that are necessary for the image formation. Based on an instruction from the control part 59, the motor controller 57 controls the operations of various kinds of motors (the photosensitive body motor, the transfer belt motor, etc.) inside the image forming apparatus 1. Based on an instruction from the control part 59, the fuser controller 58 operates the heater of the fuser part 26 to control the operation of the fuser part 26.

The belt unit 40 has a memory part 40*a*. The memory part 40*a* is configured using RFID (Radio Frequency Identifier) tag for example, and can store information such as alarm information INF (mentioned below) based on an instruction from the control part 59.

The unwanted object detection part 60 detects whether the unwanted object 9*b* (label waste) is adhering to the transfer belt 42 based on the detection result of the line sensor 61. The unwanted object detection part 60 has the line sensor 61, an image analysis part 62, and a determination part 63. The image analysis part 62 performs an image analysis based on an image indicated by the image data generated by the image processing part 52 (image P1) and an image based on the imaging result by the line sensor 61 (photographed image P2). The determination part 63 determines whether the unwanted object 9*b* is adhering to the transfer belt 42 based on the image analysis result by the image analysis part 62.

The control part 59 controls the whole operation of the image forming apparatus 1 by controlling the operation of each block inside the image forming apparatus 1. Also, as mentioned below, the control part 59 also has a function to stop the mechanical operation of the image forming apparatus 1 if it detects that the unwanted object 9*b* is adhering to the transfer belt 42.

The function of the control part 59 can be realized either using hardware or software for example.

Here, the transfer belt 42 corresponds to a specific example of the "carrying member" in this invention. The belt unit 40 corresponds to a specific example of the "carrying part" in this invention. The secondary transfer roller 24 corresponds to a specific example of the "transfer member" in this invention. The line sensor 61 corresponds to a specific example of the "first detection part" in this invention. The image analysis part 62, the judgment part 63, and the control part 59 correspond to a specific example of the "control part" in this invention. The image forming units 30 correspond to a specific example of the "development part" in this invention.

[Operations and Actions]

Subsequently, the operations and actions of the image forming apparatus 1 of this embodiment are explained.

(Outline of the Overall Operation)

First, the outline of the overall operation of the image forming apparatus 1 is explained referring to FIGS. 1 and 4. Once the communication part 51 receives print data, the control part 59 controls individual blocks of the image forming apparatus 1 so that the image forming apparatus 1 performs a print operation. The image processing part 52 generates image data (bitmap data) based on the print data. The exposure controller 55 controls the operations of the five exposure parts 39 using the image data generated by the image processing part 52. The voltage generation part 56 generates various kinds of voltages (the charging voltage, the development voltage, the supply voltage, the primary transfer voltage, the secondary transfer voltage, etc.) necessary for an image formation. The motor controller 57 controls the operations of various kinds of motors (the photosensitive body motor, the transfer belt motor, etc.) inside the image forming apparatus 1. The fuser controller 58 controls the operation of the fuser part 26 by operating the heater of the fuser part 26.

In each of the five image forming units 30, an electrostatic latent image is formed on the surface of the photosensitive body 31, and a toner image according to the electrostatic latent image is formed (developed). Each of the five primary transfer rollers 41 transfers (primary-transfers) the toner image formed on the photosensitive body 31 of the corresponding image forming unit 30 onto the transfer target surface of the transfer belt 42. The toner image on the transfer belt 42 is carried to the secondary transfer part 25 by the transfer belt 42 being cyclically carried.

The carrying roller 12 extracts the recording medium 9 from a wound roll of the recording medium 9, and carries the recording medium 9 along the carrying path 8. The label sensor 13 detects the position of each label 9*a* of the recording medium 9. The cutting part 14 cuts the recording medium 9 by a prescribed number of labels 9*a* specified by the user as one unit for example based on the detection result of the label sensor 13. The carrying rollers 21 and 22 carry the recording medium 9 along the carrying path 8. The label sensor 23 detects the position of the label 9*a* of the recording medium 9.

The secondary transfer part 25 transfers (secondary-transfers) the toner image on the transfer target surface of the transfer belt 42 to the transfer target surface (label face) of the recording medium 9. The fuser part 26 fuses the toner image onto the recording medium 9. The ejection roller 27 ejects the recording medium 9 with the toner image fused by the fuser part 26 from the image forming apparatus 1.

After the secondary transfer part 25 transferred (secondary-transferred) the toner image on the transfer belt 42 to the recording medium 9, the transfer belt 42 continues to be cyclically carried. The line sensor 61 images the transfer target surface of the transfer belt 42. The cleaning device 48 cleans the transfer belt 42 by scraping off any toner remaining on the transfer target surface of the transfer belt 42. Then, the transfer belt 42 is carried to the image forming unit 30.

(Concerning the Detection of the Unwanted Object 9*b*)

In the image forming apparatus 1, while carrying the recording medium 9 along the carrying path 8, for example, the label waste (unwanted object 9*b*) surrounding the labels 9*a* can peel off inside the image forming apparatus. The unwanted object 9*b* that peeled off in this manner, for example, can adhere to the transfer belt 42 in the secondary transfer part 25. In this case, because the transfer belt 42 to which the unwanted object 9*b* is adhering is cyclically carried in the carrying direction F2, the belt unit 40 can fail. Also, by the transfer belt 42 to which the unwanted object 9*b* is adhering being cyclically carried, if the unwanted object 9*b* reaches the image forming unit 30, the image forming unit 30 can fail. Then, in the image forming apparatus 1, the line sensor 61 that images the transfer belt 42 is installed in the downstream side of the secondary transfer part 25 in the carrying direction F2 of the transfer belt 42, and based on the imaging result by this line sensor 61, whether the unwanted object 9*b* is adhering to the transfer belt 42 is detected. Then, if the unwanted object 9*b* is adhering to the transfer belt 42, the mechanical operation of the image forming apparatus 1 is stopped. Then, the image forming apparatus 1 prompts the user to clean the transfer belt 42, and afterwards checks that the unwanted object 9*b* is not adhering to the transfer belt 42 based on the imaging result by the line sensor 61. Below, this operation is explained in detail.

Figure 5A:
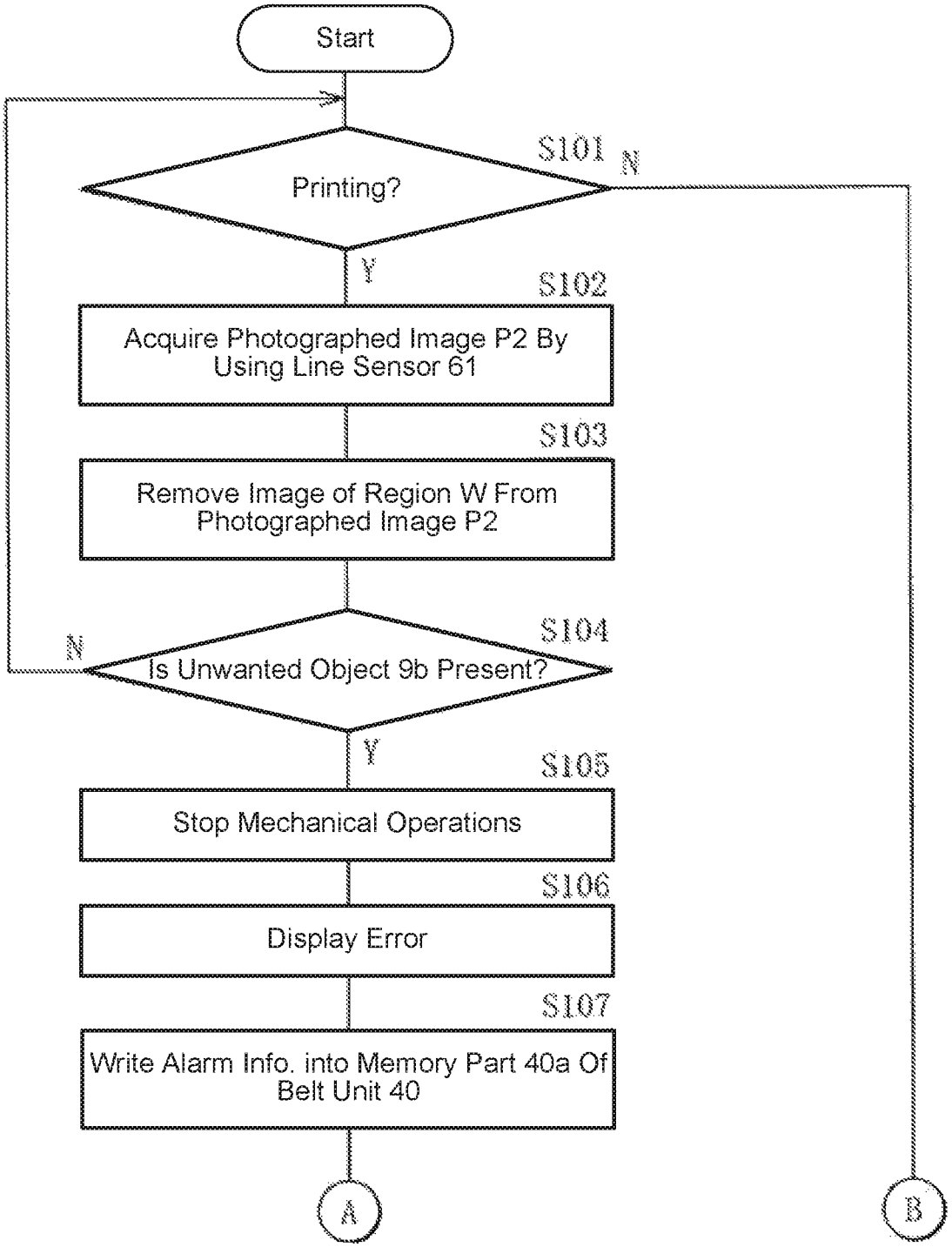
FIG. 5A is a flowchart showing an operation example of the image forming apparatus shown in FIG. 1.
Figure 5B:
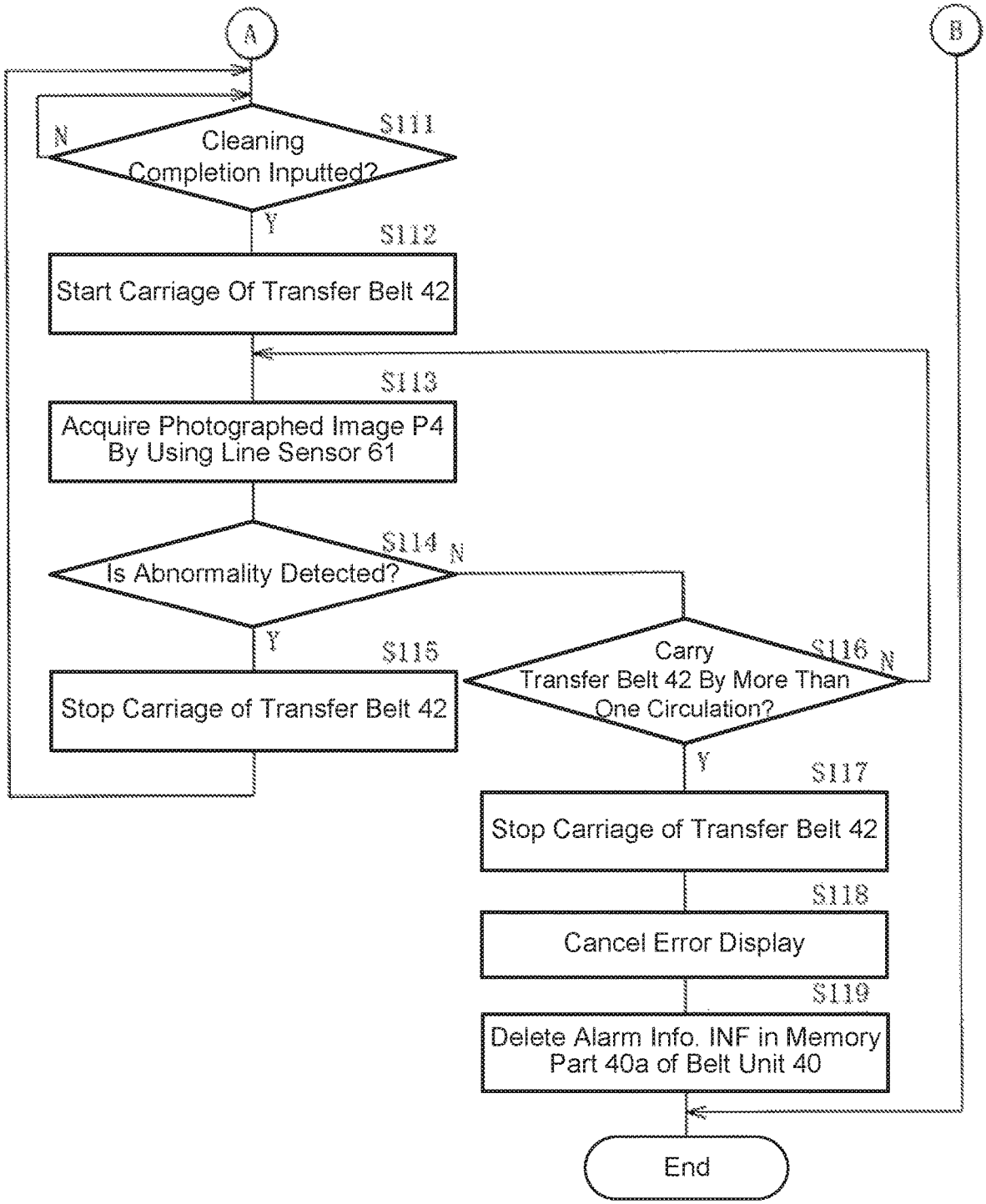
FIG. 5B is another flowchart showing one operation example of the image forming apparatus shown in FIG. 1.

Shown in FIGS. 5A and 5B is an operation example of the image forming apparatus 1 in detecting the unwanted object 9*b*.

First, the control part 59 checks whether the image forming apparatus 1 is printing (S101). If it is not printing ("N" in S101), this flow ends.

If it is printing in S101 ("Y" in S101), the unwanted object detection part 60 acquires an image (photographed image P2) using the line sensor 61 (S102).

Next, the image analysis part 62 of the unwanted object detection part 60 removes from the photographed image P2 the image in a region W where the toner image is disposed (S103). Specifically, the image analysis part 62 first specifies the region W where the toner image is disposed based on the image indicated by the image data generated by the image processing part 52 (image P1). Then, the image analysis part 62 removes the image in this region W from the photographed image P2 to obtain an analysis image P3.

Then, based on this analysis image P3, the determination part 63 determines whether the unwanted object 9*b* is present (S104). Specifically, the determination part 63 compares individual pixel values in the analysis image P3 with a prescribed pixel value (or a threshold value), and if the pixel values exceed the prescribed pixel value in a pixel region of a prescribed size, it determines that the unwanted object 9*b* is present. That is, if large pixel values that can never occur in the normal operation are confirmed in a pixel region of the prescribed size, the determination part 63 determines that the unwanted object 9*b* is present. If the unwanted object 9*b* is absent ("N" in S104), it returns to S101.

The pixel region of the prescribed size may be determined by a length (XX mm or larger) or an area (XX $mm^2$ or larger). It is also practical to request the operator to input the minimal value "XX" with the display. For example, a width XX mm of the unwanted object 9*b*, which is attached on the backing sheet together with the labels, may be input from MENU section.

The large pixel value that can never occur is determined, for example, as follows. When there is no unwanted object like in FIG. 7B, pixel values obtained in the background are expected to be ranged within certain values such that the pixels have an average value $\alpha$ with certain variation. When there is an unwanted object like in FIG. 8B, the pixel values of the unwanted object have different values such that these pixels have a different average value from the average value $\alpha$, which is another average value $\beta$. The large pixel value that can never occur is determined, for example, based on the average value $\beta$. The average value $\alpha$ varies according to status of printing, sheet carrying, warming up etc., or operations of belt (or printer). For example, assuming that (a length of maximum width of pixel drawn in one label)+(a length regulated by a print error range occurring at a normal printing)=(a length of maximum width at a normal printing including errors), when an image is longer than the length of maximum width at a normal printing including errors, such an image is categorized to fall within the "large pixel value that can never occur."

Below, the operations in S102-104 are explained citing several examples. First, the operation when the unwanted object 9*b* is absent is explained, and afterwards the operation when the unwanted object 9*b* is present is explained.

Figure 6:
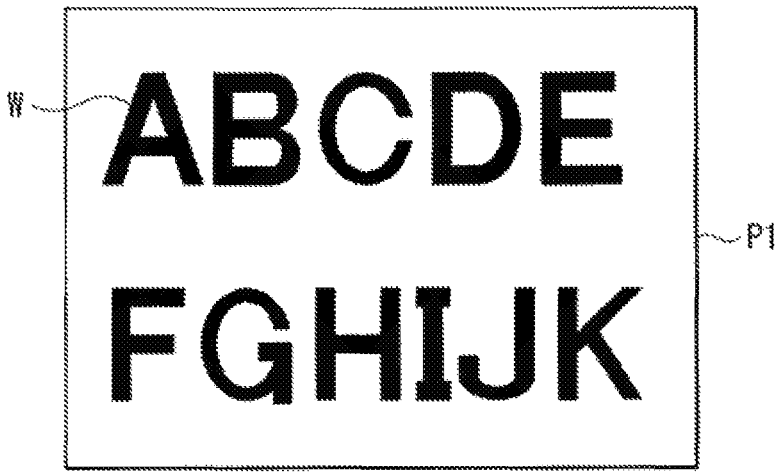
FIG. 6 is an image diagram showing an operation example of the image forming apparatus shown in FIG. 1.
Figure 7A:
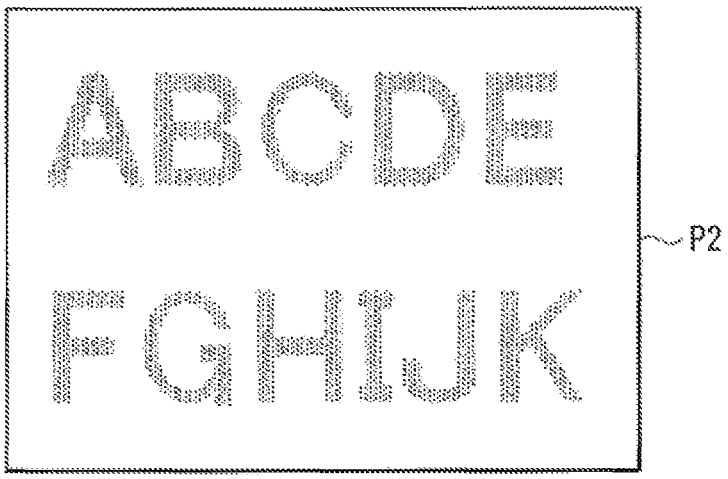
FIG. 7A is another image diagram showing one operation example of the image forming apparatus shown in FIG. 1.
Figure 7B:
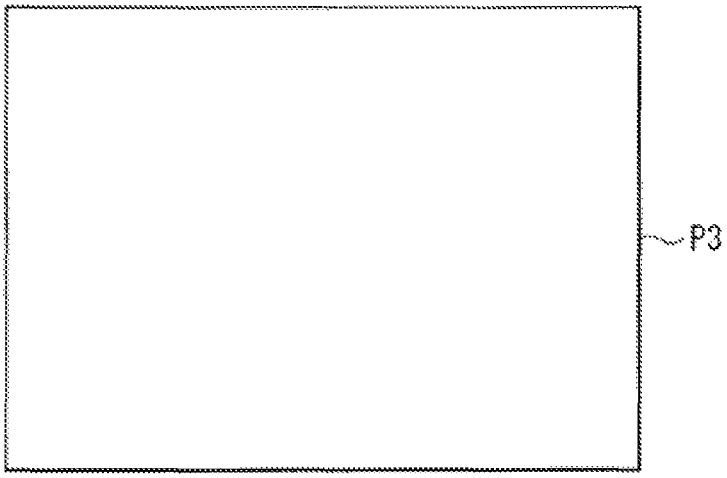
FIG. 7B is another image diagram showing one operation example of the image forming apparatus shown in FIG. 1.

Shown in FIG. 6 is an example of the image P1 indicated by the image data generated by the image processing part 52. Shown in FIG. 7A is an example of the photographed image P2 when the unwanted object 9*b* is absent, and shown in FIG. 7B is the analysis image P3 where the image in the region W was removed from the photographed image P2 shown in FIG. 7A. In FIGS. 6, 7A, and 7B, for example, white color indicates that the pixel value is low, and black color indicates that the pixel value is high.

In this example, as shown in FIG. 6, the image processing part 52 generates a bitmap image (image P1) where ten characters of alphabets from "A" to "K" are arranged. Each image forming unit 30 generates a toner image based on this image P1. This toner image is transferred to the transfer target surface of the transfer belt 42 and is carried to the secondary transfer part 25 by the transfer belt 42 being carried in the carrying direction F2. Thereby, the transfer belt 42 is holding such a toner image as shown in FIG. 6 in the upstream side of the secondary transfer part 25.

The secondary transfer part 25 transfers (secondary-transfers) the toner image on the transfer target surface of the transfer belt 42 to the transfer target surface (label face) of the recording medium 9. Thereby, although the majority of the toner on the transfer target surface of the transfer belt 42 moves to the recording medium 9, a slight amount of toner remains on the transfer target surface of the transfer belt 42. Therefore, by the line sensor 61 imaging the transfer target surface of the transfer belt 42, as shown in FIG. 7A, the photographed image P2 having the alphabets thinly remaining is obtained (S102).

The image analysis part 62 removes from this photographed image P2 the image in the region W where the toner image is disposed (S103). First, based on the image P1 (FIG. 6), the image analysis part 62 specifies the pixel region configuring the alphabets as the region W. Then, the image analysis part 62 removes the image in this region W from the photographed image P2 (FIG. 7A). Specifically, the image analysis part 62 sets to "0" the pixel values in this pixel region corresponding to this region W of the photographed image P2 (FIG. 7A). Thereby, the image analysis part 62 obtains the analysis image P3 where the pixel values are nearly "0" over the entire region as shown in FIG. 7B.

Then, based on the analysis image P3, the determination part 63 determines whether the unwanted object 9*b* is present (S104). Specifically, the determination part 63 compares individual pixel values in the analysis image P3 with the prescribed pixel value, and checks whether the pixel values exceed the prescribed pixel value in the pixel region of the prescribed size. In this example, as shown in FIG. 7B, the pixel values are nearly "0" over the entire region. Therefore, the determination part 63 determines that the unwanted object 9*b* is absent.

On the other hand, if the unwanted object 9*b* is adhering to the transfer belt 42, the photographed image P2 also contains information on the unwanted object 9*b* in addition to the remaining toner.

Figure 8A:
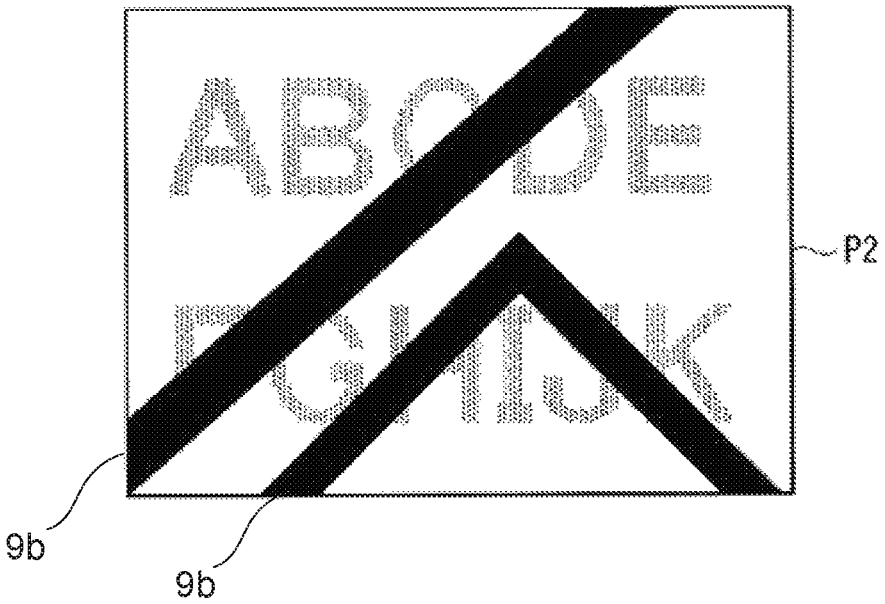
FIG. 8A is another image diagram showing one operation example of the image forming apparatus shown in FIG. 1.
Figure 8B:
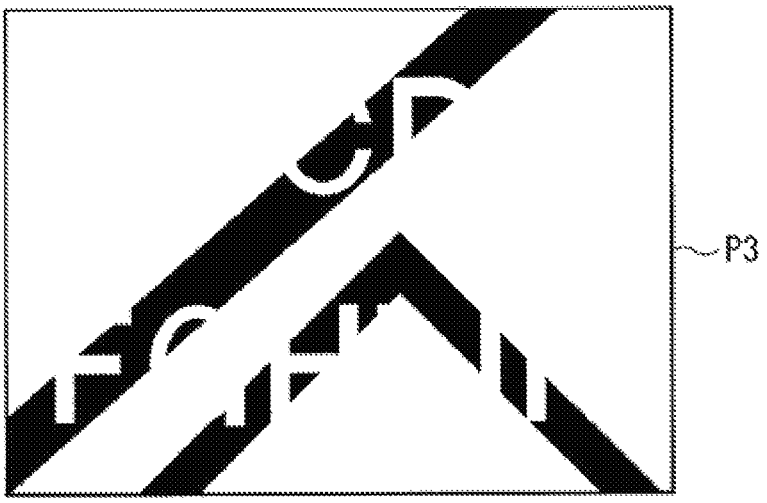
FIG. 8B is another image diagram showing one operation example of the image forming apparatus shown in FIG. 1.

Shown in FIG. 8A is an example of the photographed image P2 when the unwanted object 9*b* is present, and shown in FIG. 8B is the analysis image P3 where the region W was removed from the photographed image P2 shown in FIG. 8A. In FIG. 8A, the part shown in black color indicates the unwanted object 9*b*.

In this case also, the image analysis part 62 removes the image in the pixel region configuring the alphabets (region W) from the photographed image P2 (FIG. 8A) (S103). Thereby, as shown in FIG. 8B, the image analysis part 62 obtains the analysis image P3 containing information on the unwanted object 9*b*. Then, based on this analysis image P3, the determination part 63 determines whether the unwanted object 9*b* is present (S104). In this example, because the analysis image P3 contains information on the unwanted object 9*b*, the determination part 63 finds that pixel values exceed the prescribed pixel value in the pixel region of the prescribed size. As the result, the determination part 63 determines that the unwanted object 9*b* is present.

In S104 (FIG. 5A), if the unwanted object 9*b* is present ("Y" in S104), based on an instruction from the determination part 63 of the unwanted object detection part 60, the control part 59 stops the mechanical operation of the image forming apparatus 1 (S105). Specifically, by controlling the operation of the motor controller 57, for example, the control part 59 stops the carrying operation of the transfer belt 42 in the belt unit 40, the carrying operation of the recording medium 9, the rotation operations of the photosensitive bodies 31 and various kinds of rollers in the image forming units 30, etc. In doing so, the control part 59 performs such a control as to raise the five image forming units 30 so that the image forming units 30 separate from the transfer belt 42. Also, the control part 59 performs such a control as to lower the secondary transfer roller 24 so that the secondary transfer roller 24 separates from the transfer belt 42.

Next, based on an instruction from the control part 59, the display part 54 displays an error (S106). In doing so, the display part 54 also displays a message prompting the user to clean the transfer belt 42.

Next, the control part 59 write the alarm information INF into the memory part 40*a* of the belt unit 40 (S107).

Afterwards, according to the information displayed on the display part 54, the user opens a cover of the image forming apparatus 1 and cleans the transfer belt 42. Then, once the cleaning of the transfer belt 42 is complete, the user closes the cover. Then, the user operates the control part 53 to input the fact that the cleaning is complete.

Next, as shown in FIG. 5B, the control part 59 checks whether the fact that the cleaning is complete has been inputted (S111). Then, the control part 59 repeats this S111 until the fact that the cleaning is complete is inputted.

In S111, if the fact that the cleaning is complete has been inputted by the user ("Y" in S111), the control part 59 controls the operation of the motor controller 57 to start the cyclical carriage of the transfer belt 42 of the belt unit 40 (S112). Thereby, the transfer belt 42 is cyclically carried in a state where the image forming units 30 are separated from the transfer belt 42, and the secondary transfer roller 24 is separated from the transfer belt 42.

Next, the unwanted object detection part 60 acquires an image (photographed image P4) using the line sensor 61 (S113).

Next, based on the photographed image P4, the unwanted object detection part 60 detects whether there is an abnormality (S114). Specifically, the unwanted object detection part 60 compares individual pixel values in the photographed image P4 with a prescribed pixel value, and if the pixel values exceed the prescribed pixel value in a pixel region of a prescribed size, it determines that there is an abnormality.

If the transfer belt 42 has been properly cleaned by the user, the photographed image P4 has nearly "0" pixel values over the entire region. Therefore, the unwanted object detection part 60 determines that there is no abnormality. Also, if the transfer belt 42 has not been properly cleaned, the photographed image P4 contains information on the unwanted object 9*b* for example. Therefore, the unwanted object detection part 60 determines that there is an abnormality, or if abnormality is detected.

In S114, if there is an abnormality ("Y" in S114), the control part 59 controls the operation of the motor controller 57 to stop the cyclical carriage of the transfer belt 42 of the belt unit 40 (S115), and returns to S111. Thereby, the image forming apparatus 1 prompts the user to clean the transfer belt 42 again.

In S114, if there is no abnormality ("N" in S114), the control part 59 checks whether the transfer belt 42 has been cyclically carried by more than one circulation, or one lap (S116). If the transfer belt 42 has not been cyclically carried by more than one circulation ("N" in S116), it returns to S113.

In S116, if the transfer belt 42 has been cyclically carried by more than one circulation ("Y" in S116), the control part 59 controls the operation of the motor controller 57 to stop the cyclical carriage of the transfer belt 42 of the belt unit 40 (S117). Then, the control part 59 performs such controls as to lower the five image forming units 30 and also raise the secondary transfer roller 24. Thereby, the image forming apparatus 1 becomes capable of performing a print operation.

Next, the display part 54 cancels (or eliminates) the error display based on an instruction from the control part 59 (S118).

Then, the control part 59 deletes the alarm information INF written in the memory part 40*a* of the belt unit 40 (S119).

Here, this flow ends.

In this manner, in the image forming apparatus 1, the line sensor 61 that images the transfer belt 42 is installed in the downstream side of the secondary transfer part 25, and if the unwanted object 9*b* adheres to the transfer belt 42, the mechanical operation of the image forming apparatus 1 is stopped. Then, in the image forming apparatus 1, the user is prompted to clean the transfer belt 42. Thereby, in the image forming apparatus 1, the risk that the belt unit 40 fails can be reduced. Also, because the risk that the unwanted object 9*b* reaches the image forming units 30 by the transfer belt 42 to which the unwanted object 9*b* is adhering being cyclically carried can be reduced, the risk that the image forming units 30 fail can be reduced.

Also, in the image forming apparatus 1, based on the image (image P1) indicated by the image data generated by the image processing part 52, the image analysis part 62 specifies the region W where the toner image is disposed and obtains the analysis image P3 by removing the image in this region W from the photographed image P2. Then, based on this analysis image P3, the determination part 63 determines whether the unwanted object 9*b* is present. In other words, by masking the region W in the photographed image P2 based on the image P1, the image analysis part 62 determines the target region for processing by the determination part 63. Thereby, in the image forming apparatus 1, in judging whether the unwanted object 9*b* is present, the risk of being influenced by the toner remaining on the transfer belt 42 can be reduced. As the result, in the image forming apparatus 1, the accuracy to detect the presence/absence of the unwanted object 9*b* can be enhanced.

In the image forming apparatus 1, as shown in S107 in FIG. 5A, if the fact that the unwanted object 9*b* is adhering to the transfer belt 42 is detected, the alarm information INF is written into the memory part 40*a* of the belt unit 40. Thereby, for example, as explained below, even when powering up, recovering from a sleep state, or replacing the belt unit 40, the risk that the belt unit 40 or any of the image forming units 30 fails can be reduced.

Figure 9:
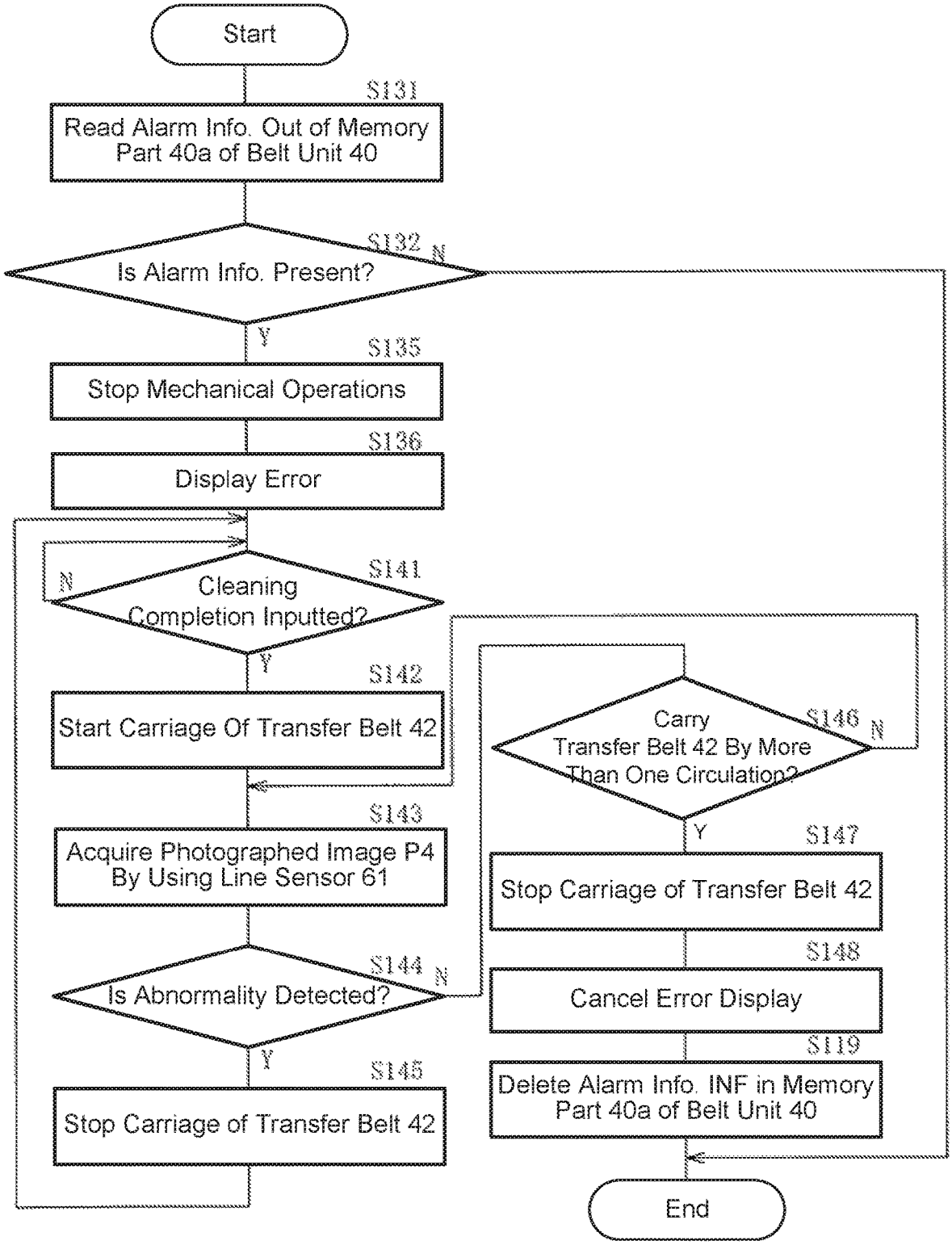
FIG. 9 is another flowchart showing one operation example of the image forming apparatus shown in FIG. 1.

Shown in FIG. 9 is an operation example of the image forming apparatus 1 when powering up, recovering from the sleep state, or replacing the belt unit 40.

First, the control part 59 reads information out of the memory part 40*a* of the belt unit 40 (S131). If the alarm information INF has not been written in the memory part 40*a* ("N" in S132), this flow ends.

In S132, if the alarm information INF has been written and is present in the memory part 40*a* ("Y" in S132), in the same manner as in S105 (FIG. 5A), the control part 59 stops the mechanical operation of the image forming apparatus 1 (S135). In doing so, the control part 59 performs such a control as to raise the five image forming units 30 so that the image forming units 30 separate from the transfer belt 42. Also, the control part 59 performs such a control as to lower the secondary transfer roller 24 so that the secondary transfer roller 24 separates from the transfer belt 42.

Next, the display part 54 displays an error based on an instruction from the control part 59 (S136). In doing so, the display part 54 also displays a message prompting the user to clean the transfer belt 42.

Afterwards, according to the information displayed on the display part 54, the user opens the cover of the image forming apparatus 1 and cleans the transfer belt 42. Then, once the cleaning of the transfer belt 42 is complete, the user closes the cover. Then, the user operates the operation part 53 to input the fact that the cleaning is complete.

The control part 59 checks whether the fact that the cleaning is complete has been inputted by the user (S141). Then, the control part 59 repeats this S141 until the fact that the cleaning is complete is inputted.

In S141, if the fact that the cleaning is complete has been inputted by the user ("Y" in S141), the control part 59 controls the operation of the motor controller 57 to start the cyclical carriage of the transfer belt 42 of the belt unit 40 (S142). Thereby, the transfer belt 42 is cyclically carried in a state where the image forming units 30 are separated from the transfer belt 42, and the secondary transfer roller 24 is separated from the transfer belt 42.

Next, the unwanted object detection part 60 acquires an image (photographed image P4) using the line sensor 61 (S143).

Next, based on the photographed image P4, in the same manner as in S114 (FIG. 5B), the unwanted object detection part 60 detects whether there is an abnormality (S144). In S144, if there is an abnormality ("Y" in S144), the control part 59 controls the operation of the motor controller 57 to stop the cyclical carriage of the transfer belt 42 of the belt unit 40 (S145), and returns to S141. Thereby, the image forming apparatus 1 prompts the user to clean the transfer belt 42.

In S144, if there is no abnormality ("N" in S144), the control part 59 checks whether the transfer belt 42 has been cyclically carried by more than one circulation (S146). If the transfer belt 42 has not been cyclically carried by more than one circulation yet ("N" in S146), it returns to S143.

In S146, if the transfer belt 42 has been cyclically carried by more than one circulation ("Y" in S146), the control part 59 controls the operation of the motor controller 57 to stop the cyclical carriage of the transfer belt 42 of the belt unit 40 (S147). Then, the control part 59 performs such controls as to lower the five image forming units 30 and raise the secondary transfer roller 24. Thereby, the image forming apparatus 1 becomes capable of performing a print operation.

Next, based on an instruction from the control part 59, the display part 54 cancels the error display (S148).

Then, the control part 59 deletes the alarm information INF written in the memory part 40*a* of the belt unit 40 (S149).

Here, this flow end.

In this manner, in the image forming apparatus 1, the alarm information INF is stored in the memory part 40*a* of the belt unit 40, and the alarm information INF is read out when powering up, recovering from the sleep state, or replacing the belt unit 40. Then, in the image forming apparatus 1, based on this alarm information INF, the user is prompted to clean the transfer belt 42. Thereby, in the image forming apparatus 1, the risk of performing a print operation with the unwanted object 9*b* adhering to the transfer belt 42 can be reduced, thereby reducing the risk that the belt unit 40 or any of the image forming units 30 fails.

[Efficacy]

As stated above, in this embodiment, because the line sensor that images the transfer belt is installed in the downstream side of the secondary transfer part, if an unwanted object adheres to the transfer belt, the mechanical operation of the image forming apparatus can be stopped, reducing the risk that the image forming apparatus fails.

In this embodiment, the alarm information is stored in the memory part of the belt unit, and the alarm information is read out from the memory part when powering up, recovering from the sleep state, or replacing the belt unit. Thereby, based on this alarm information, the user can be prompted to clean the transfer belt, thereby reducing the risk that the image forming apparatus fails.

2. Second Embodiment

Next, an image forming apparatus 2 of the second embodiment is explained. In this embodiment, in addition to the downstream side of a secondary transfer part 25, also in the upstream side of the secondary transfer part 25, a line sensor that images a transfer belt 42 is installed. Note that essentially the same components as those in the image forming apparatus 1 of the first embodiment mentioned above are given the same codes, and their explanations are omitted.

Figure 10:
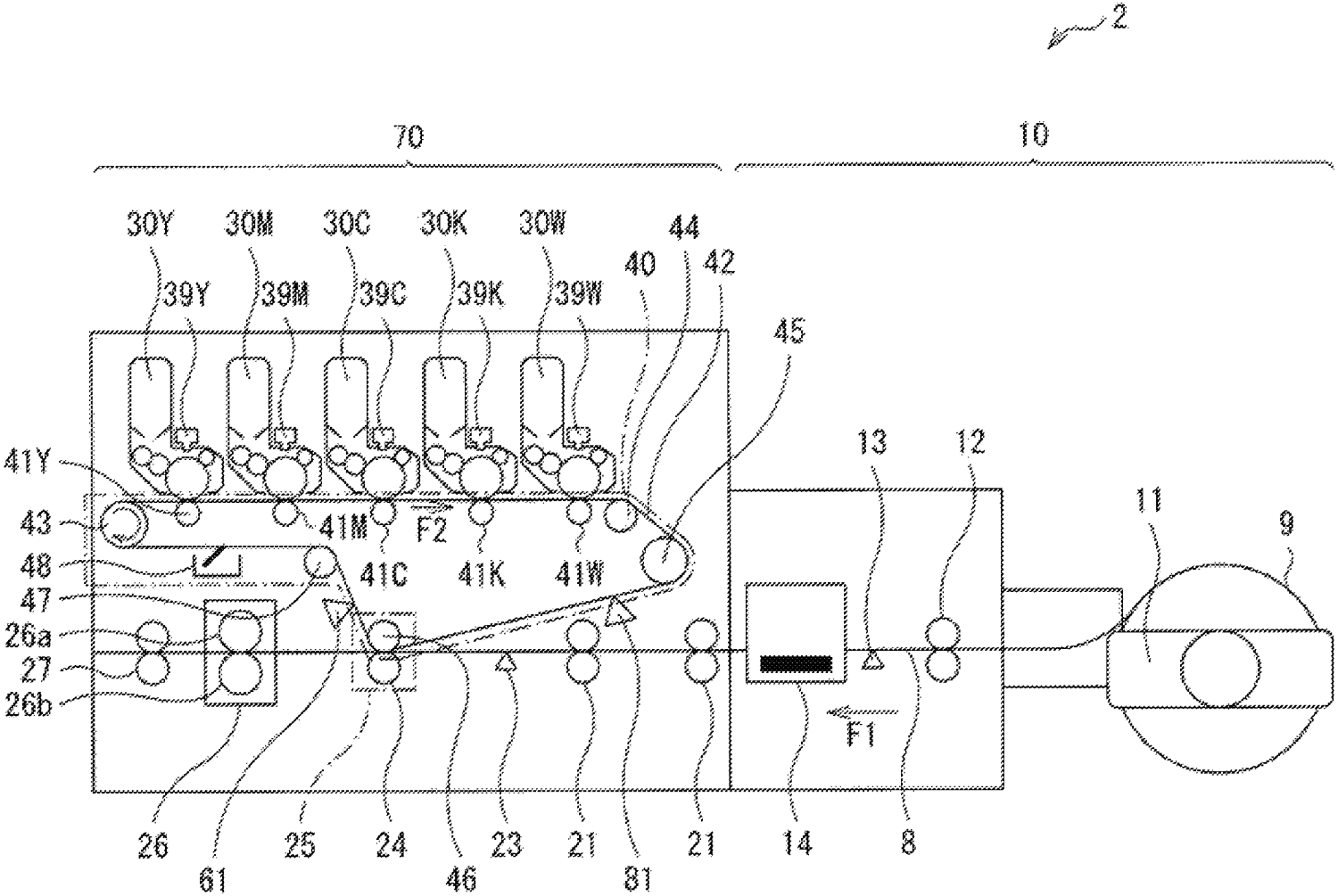
FIG. 10 is an explanatory diagram showing a configuration example of an image forming apparatus according to the second embodiment.

Shown in FIG. 10 is a configuration example of the image forming apparatus 2. The image forming apparatus 2 is provided with a medium supply part 10 and an image forming part 70. The image forming part 70 has a line sensor 81. The line sensor 81 has light-receiving elements disposed in a row and images the transfer target surface of the transfer belt 42. The line sensor 81 is disposed in the upstream side of the secondary transfer part 25 in the carrying direction F2 of the transfer belt 42.

Figure 11:
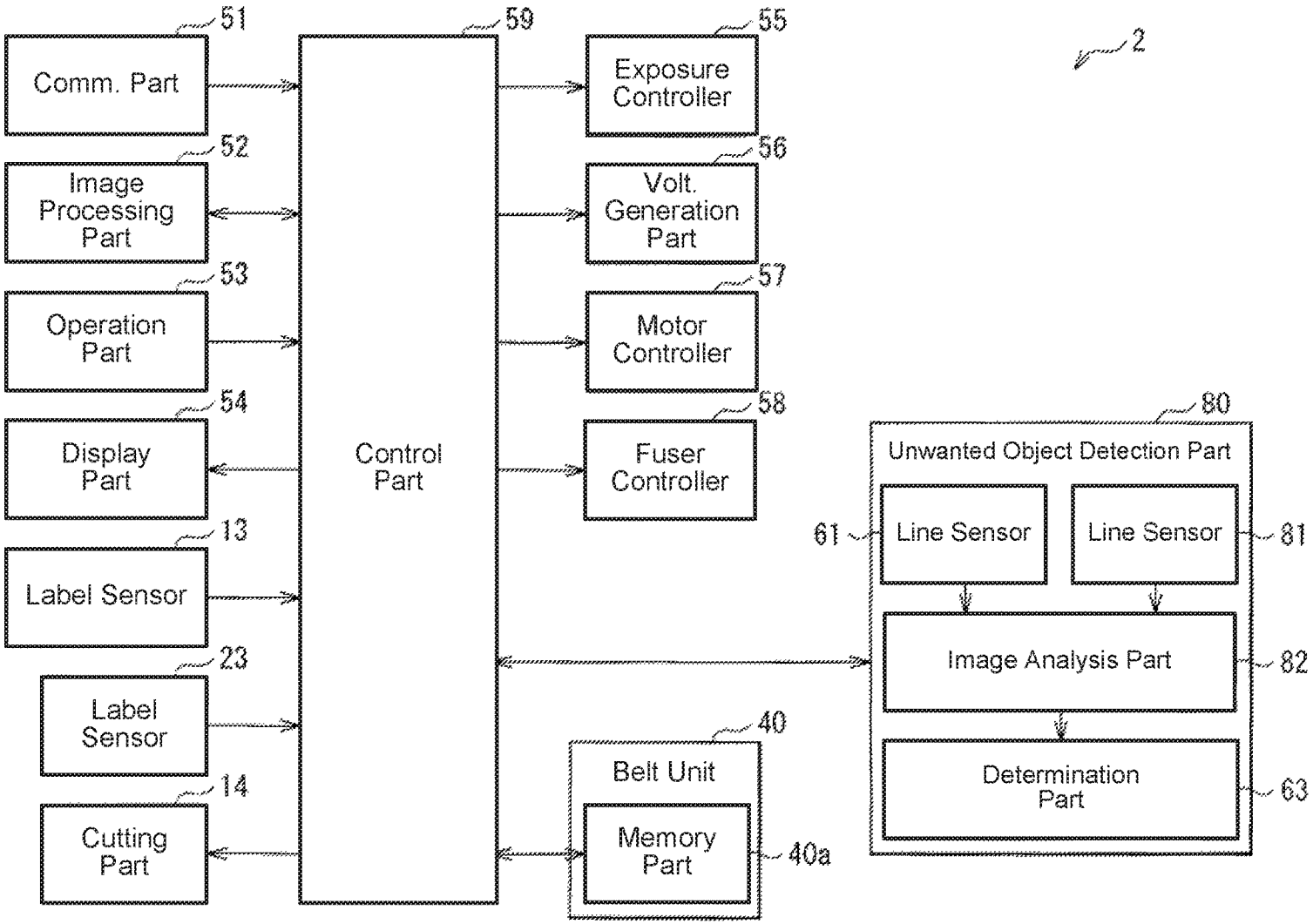
FIG. 11 is a block diagram illustrating a configuration example of the image forming apparatus illustrated in FIG. 10.

Shown in FIG. 11 is an example of the control mechanism in the image forming apparatus 2. The image forming apparatus 2 has an unwanted object detection part 80. In the same manner as the unwanted object detection part 60 of the first embodiment (FIG. 4), an unwanted object detection part 80 detects whether an unwanted object 9*b* (a label waste) is adhering to the transfer belt 42 based on the detection result of a line sensor 61. The unwanted object detection part 80 has the line sensor 61, a line sensor 81, an image analysis part 82, and a determination part 63. The image analysis part 82 performs an image analysis based on an image based on the imaging result by the line sensor 81 (an photographed image P11) and an image based on the imaging result by the line sensor 61 (an photographed image P2). That is, although the image analysis part 62 of the first embodiment performed the image analysis based on the image indicated by the image data generated by the image processing part 52 (the image P1) and the image based on the imaging result by the line sensor 61 (the photographed image P2), the image analysis part 82 of this embodiment performs the image analysis using the image based on the imaging result by the line sensor 81 (the photographed image P11) instead of the image indicated by the image data generated by the image processing part 52 (the image P1).

Here, the line sensor 81 corresponds to a specific example of the "second detection part" in this invention. The image analysis part 82, the determination part 63, and the control part 59 correspond to a specific example of the "control part" in this invention.

Figure 12A:
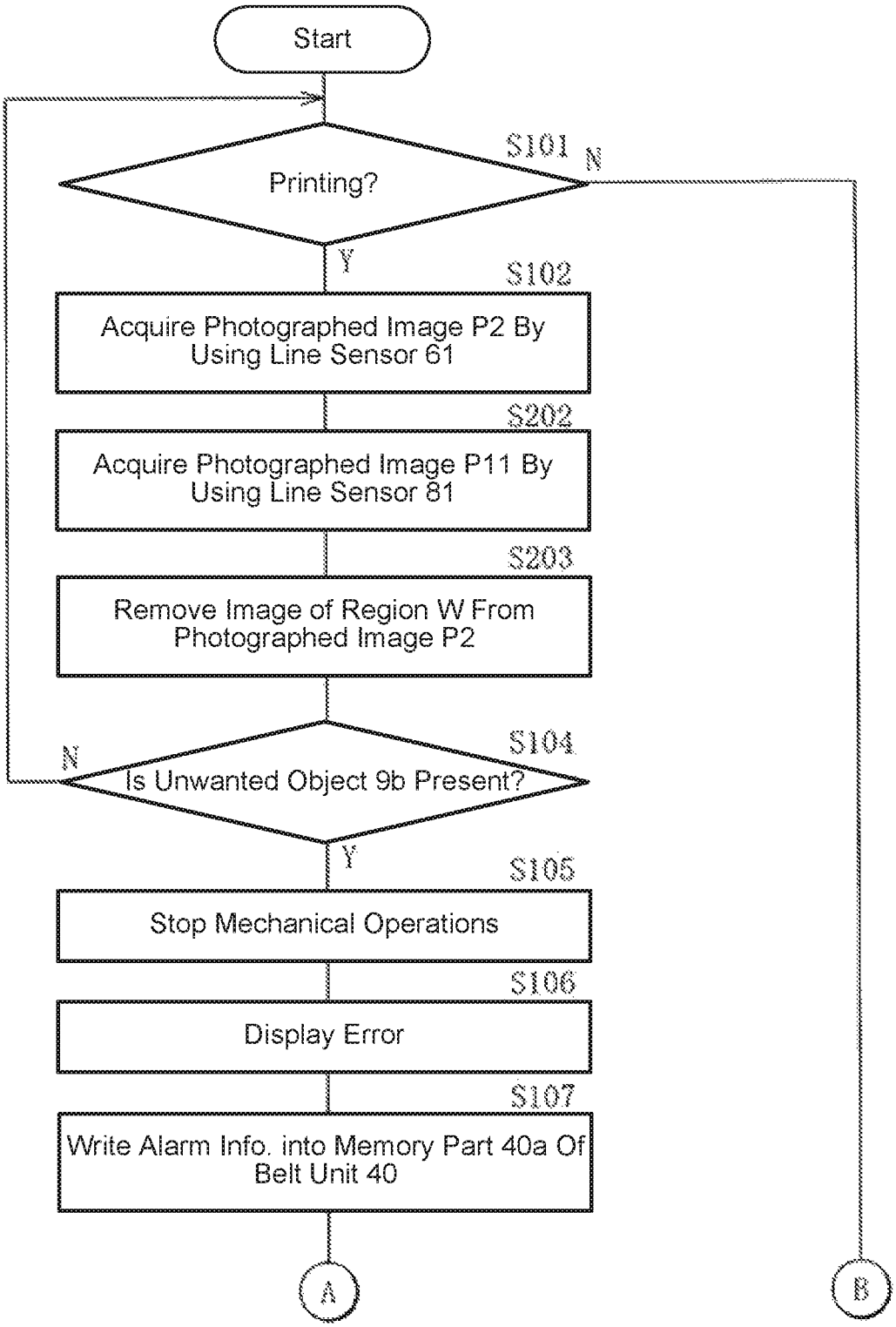
FIG. 12A is a flowchart showing an operation example of the image forming apparatus shown in FIG. 10.
Figure 12B:
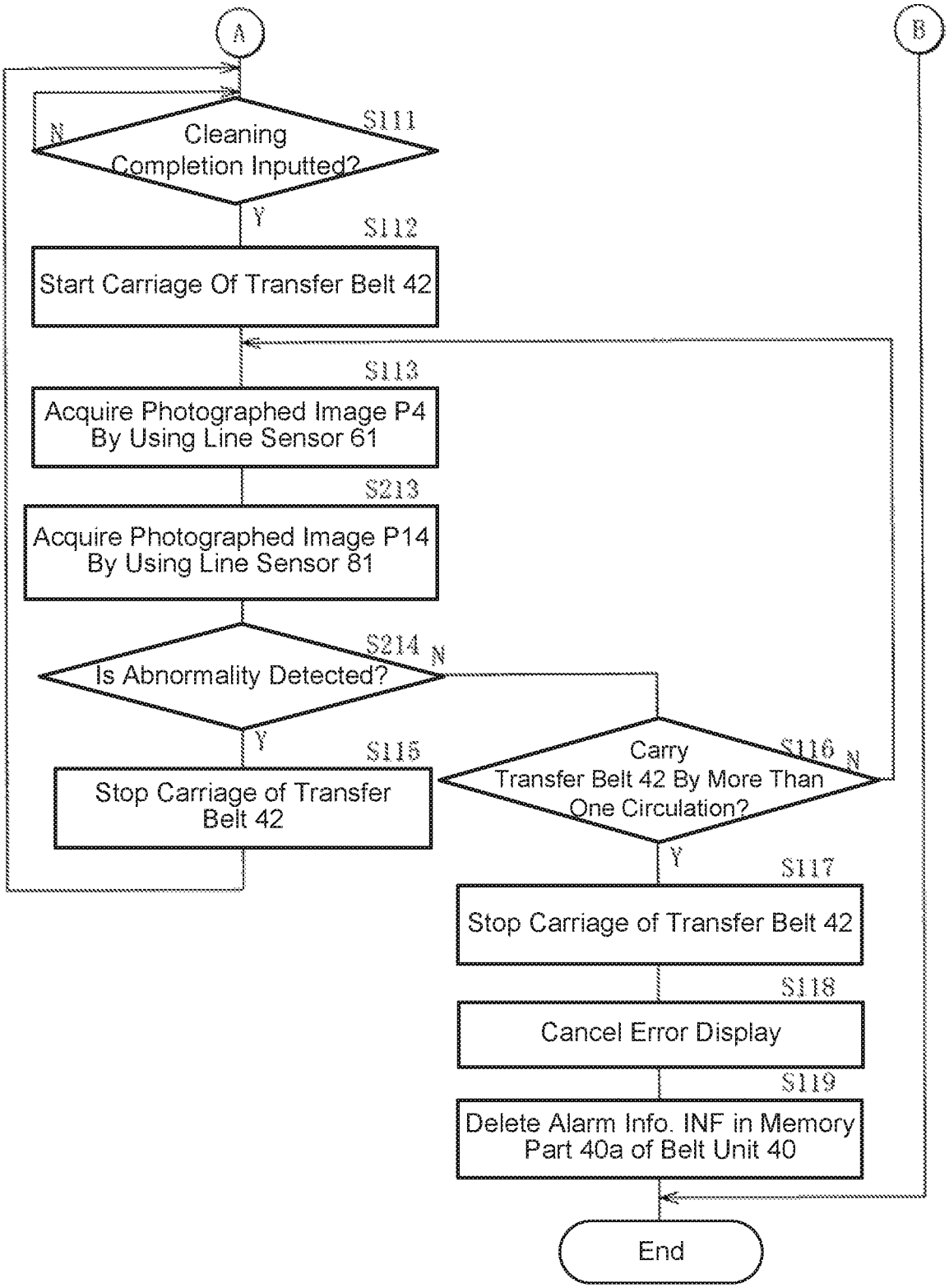
FIG. 12B is another flowchart showing one operation example of the image forming apparatus shown in FIG. 10

Shown in FIGS. 12A and 12B is an operation example of the image forming apparatus 2 when detecting the unwanted object 9*b*. In the image forming apparatus 2, the operation to detect whether the unwanted object 9*b* is present (S102, S202, S203, and S104 shown in FIG. 12A) and the operation to detect whether there is an abnormality (S113, S213, and S214 shown in FIG. 12B) are different from those in the image forming apparatus 1 (FIGS. 5A and 5B).

First, the control part 59 checks whether the image forming apparatus 2 is in printing (S101), and if it is in printing ("Y" in S101), the unwanted object detection part 80 acquires an image (photographed image P2) using the line sensor 61 in the same manner as in the first embodiment.

Next, the unwanted object detection part 80 acquires an image (photographed image P11) using the line sensor 81 (S202). This photographed image P11 shows the transfer belt 42 before the secondary transfer is performed, and corresponds to the image P1 in the above-mentioned first embodiment (FIG. 6). Note that although in this example the photographed image P11 is acquired after acquiring the photographed image P2 as shown in S102 and S202 for the convenience of explanation, this invention is not limited to this, but instead for example, these operations can be performed in parallel.

Next, the image analysis part 82 of the unwanted object detection part 80 removes the image in a region W where a toner image is disposed from the photographed image P2 (S203). Specifically, the image analysis part 82 first specifies the region W where the toner image is disposed based on the photographed image P11. Then, the image analysis part 82 removes the image in this region W from the photographed image P2 to obtain an analysis image P3.

Then, in the same manner as in the first embodiment, based on this analysis image P3, the determination part 63 determines whether the unwanted object 9*b* is present (S104). If the unwanted object 9*b* is absent ("N" in S104), it returns to S101.

In S104, if the unwanted object 9*b* is present ("Y" in S104), in the same manner as in the first embodiment, the control part 59 stops the mechanical operation of the image forming apparatus 2 based on an instruction from the determination part 63 of the unwanted object detection part 80 (S105). In doing so, the control part 59 performs such a control as to raise five image forming units 30 so that the image forming units 30 separate from the transfer belt 42. Also, the control part 59 performs such a control as to lower a secondary transfer roller 24 so that the secondary transfer roller 24 separates from the transfer belt 42. Then, based on an instruction from the control part 59, the display part 54 writes alarm information INF into a memory part 40*a* of a belt unit 40 (S107).

After cleaning the transfer belt 42, a user operates an operation part 53 to input the fact that the cleaning is complete. If the fact that the cleaning is complete has been inputted by the user ("Y" in S111), the control part 59 controls the operation of a motor controller 57 to start the cyclical carriage of the transfer belt 42 of the belt unit 40 (S112).

Next, the unwanted object detection part 80 acquires an image (photographed image P4) using the line sensor 61 (S113), and acquires an image (photographed image P14) using the line sensor 81 (S213). Note that these operations can be performed in parallel.

Next, based on the photographed images P4 and P14, the unwanted object detection part 80 detects whether there is an abnormality (S214). Specifically, the unwanted object detection part 80 compares individual pixel values in the photographed images P4 and P14 with a prescribed pixel value, and if the pixel values exceed the prescribed pixel value in a pixel region of a prescribed size, it determines that there is an abnormality.

If the transfer belt 42 has been properly cleaned by the user, the photographed images P4 and P14 have pixel values of nearly "0" over the entire region. Therefore, the unwanted object detection part 80 determines that there is no abnormality. Also, if the transfer belt 42 has not been properly cleaned, the photographed images P4 and P14 contain information on the unwanted object 9*b* for example. Therefore, the unwanted object detection part 80 determines that there is an abnormality.

In S214, if there is an abnormality ("Y" in S214), in the same manner as in the first embodiment, the control part 59 controls the operation of the motor controller 57 to stop the cyclical carriage of the transfer belt 42 of the belt unit 40 (S115), and returns to S111. Thereby, the image forming apparatus 2 prompts the user to clean the transfer belt 42 again.

In S214, if there is no abnormality ("N" in S214), the control part 59 checks whether the transfer belt 42 has been cyclically carried by more than one circulation (S116). If the transfer belt 42 has not been cyclically carried by more than one circulation ("N" in S116), it returns to S113.

The operations hereafter are the same as in the first embodiment (FIGS. 5A and 5B).

Figure 13:
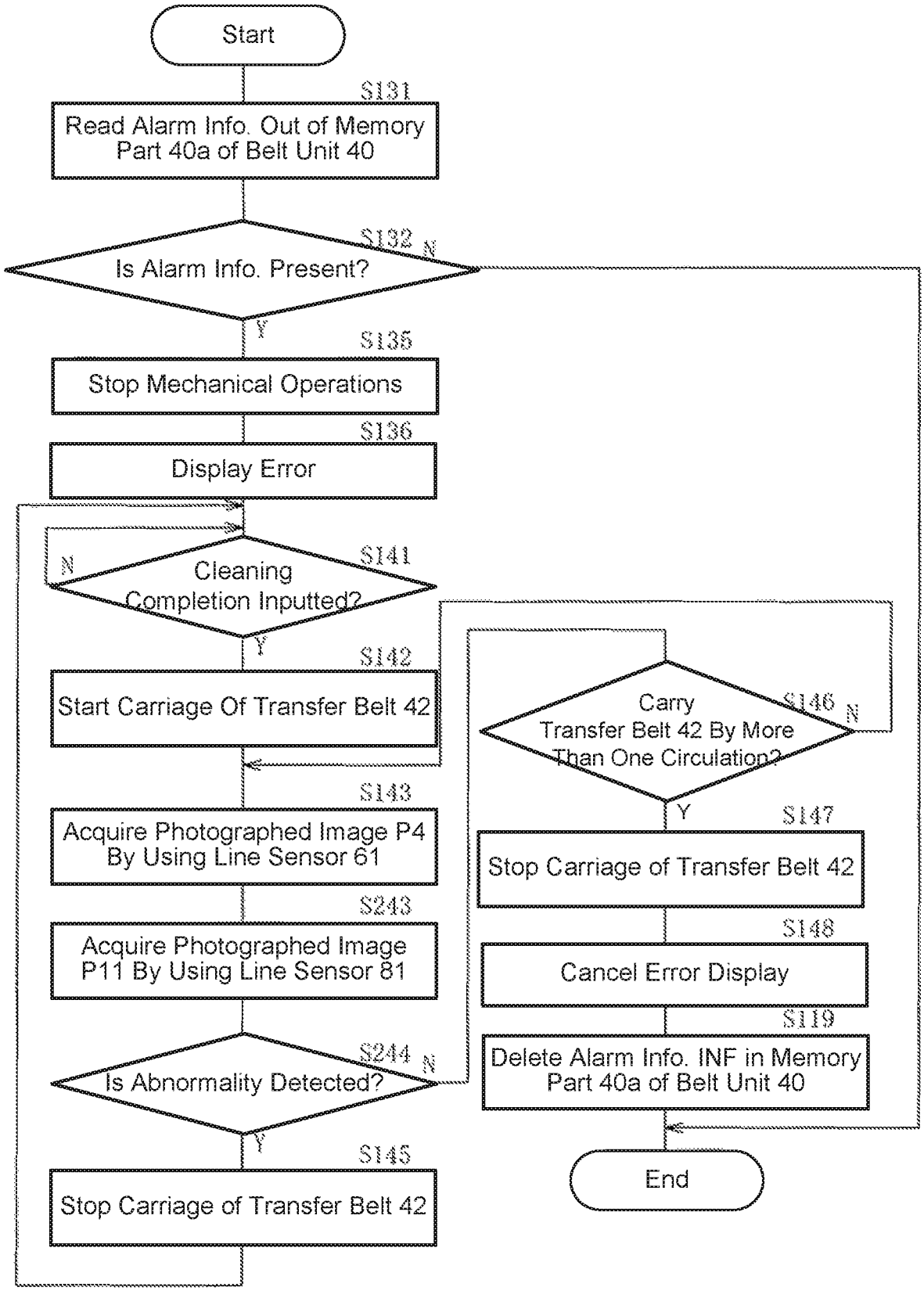
FIG. 13 is another flowchart showing one operation example of the image forming apparatus shown in FIG. 10

Shown in FIG. 13 is an operation example of the image forming apparatus 2 when powering up, recovering from a sleep state, or replacing the belt unit 40.

First, the control part 59 reads out information from the memory part 40*a* of the belt unit 40 (S131). If the alarm information INF has not been written in the memory part 40*a* ("N" in S132), this flow ends.

In S132, if the alarm information INF has been written in the memory part 40*a* ("Y" in S132), in the same manner as in S105 (FIG. 12A), the control part 59 stops the mechanical operation of the image forming apparatus 2 (S135). In doing so, the control part 59 performs such a control as to raise the five image forming units 30 so that the image forming units 30 separate from the transfer belt 42. Also, the control part 59 performs such a control as to lower the secondary transfer roller 24 so that the secondary transfer roller 24 separates from the transfer belt 42. Next, based on an instruction from the control part 59, the display part 54 displays an error (S136).

After cleaning the transfer belt 42, the user operates the operation part 53 to input the fact that the cleaning is complete. If the fact that the cleaning is complete is inputted by the user ("Y" in S141), the control part 59 controls the operation of the motor controller 57 to start the cyclical carriage of the transfer belt 42 of the belt unit 40 (S142).

Next, the unwanted object detection part 80 acquires an image (photographed image P4) using the line sensor 61 (S143), and acquires an image (photographed image P14) using the line sensor 81 (S243). Note that these operations can be performed in parallel.

Next, based on the photographed images P4 and P14, the unwanted object detection part 80 detects whether there is an abnormality (S244). Specifically, the unwanted object detection part 80 compares individual pixel values in the photographed images P4 and P14 with a prescribed pixel value, and if the pixel values exceed the prescribed pixel value in a pixel region of a prescribed size, it determines that there is an abnormality.

In S244, if there is an abnormality ("Y" in S244), in the same manner as in the first embodiment, the control part 59 controls the operation of the motor controller 57 to stop the cyclical carriage of the transfer belt 42 of the belt unit 40 (S145), and returns to S141. Thereby, the image forming apparatus 2 prompts the user to clean the transfer belt 42 again.

In S214, if there is no abnormality ("N" in S214), the control part 59 checks whether the transfer belt 42 has been cyclically carried by more than one circulation (S116). If the transfer belt 42 has not been cyclically carried by more than one circulation ("N" in S146), it returns to S143.

The operations hereafter are the same as in the first embodiment (FIGS. 5A and 5B).

In this manner, in the image forming apparatus 2, the line sensor 81 that images the transfer belt 42 is installed in the upstream side of the secondary transfer part 25, and the image analysis part 82 specifies the region W where a toner image is disposed based on the image based on the imaging result by the line sensor 81 (photographed image P11) and removes the image in this region W from the photographed image P2 to obtain the analysis image P3. That is, although in the first embodiment the region W where a toner image is disposed was specified based on the image indicated by the image data generated by the image processing part 52 (image P1), in this embodiment the region W where the toner image is disposed is specified based on the image based on the imaging result by the line sensor 81 (photographed image P11). In this manner, in the image forming apparatus 2, based on the toner image actually formed on the transfer belt 42, the region W where the toner image is disposed is specified. Thereby, in the image forming apparatus 2, for example, the region W can be specified considering an inclination, a shift in the image forming position, a color shift, etc. of the toner image on the transfer belt 42 caused by shifts in the mounting positions of the exposure part 39, the image forming units 30, and the belt unit 40. As the result, in the image forming apparatus 2, the accuracy of detecting the presence/absence of the unwanted object 9*b* can be enhanced.

In this manner, because in this embodiment a line sensor that images the transfer belt is installed in the upstream side of the secondary transfer part, and the region where the toner image is disposed is specified based on the imaging result by the line sensor, the accuracy of detecting the presence/absence of the unwanted object can be enhanced. Other effects are the same as in the above-mentioned first embodiment.

[Modification 2-1] Although in the above-mentioned embodiment, as shown in S113, S213, and S214 (FIG. 12B) for example, the presence of an abnormality was detected based on the detection results of the line sensors 61 and 81, this invention is not limited to this. Instead, for example, the presence of an abnormality can be detected based on the detection result of the line sensor 81, or the presence of an abnormality can be detected based on the detection result of the line sensor 61.

In the same manner, although in the above-mentioned embodiment, as shown in S143, S243, and S244 (FIG. 13) for example, the presence of an abnormality was detected based on the detection results of the line sensors 61 and 81, this invention is not limited to this.

In the above, although this technology was explained citing some embodiments and a modification, this technology is not limited to these embodiments etc., but various kinds of modifications are possible.

For example, although in the above-mentioned embodiments etc., an adhering object was detected using the optical line sensor 61, this invention is not limited to this. Instead, for example, a sensor that detects an adhering object with another method than the optical one, such as the electrostatic method, can be used.

Also, for example, although in the above-mentioned embodiments etc., the five image forming units 30 were installed, this invention is not limited to this, but four or fewer image forming units 30 can be installed, or six or more image forming units 30 can be installed. Also, although the multiple image forming units 30 formed toner images of different colors from one another, this invention is not limited to this, but part or all of the multiple image forming units 30 can form toner images of the same color.

Also, for example, although in the above-mentioned embodiments etc., a label waste adhering to the transfer belt 42 was detected, this invention is not limited to this, but for example, various kinds of objects that should not adhere to the transfer belt 42, such as the label 9*a* and a piece of paper adhering to the transfer belt 42, can be detected.

Also, for example, although in the above-mentioned embodiments etc., as shown in FIG. 2, the recording medium 9 including the labels 9*a* and the label waste surrounding the labels 9*a* was used, this invention is not limited to this, but instead, for example, a recording medium with the label waste peeled off in advance. In this case also, for example, if the label 9*a* adheres to the transfer belt 42, by detecting this label 9*a*, the risk that the image forming apparatus fails can be reduced.

Also, for example, although in the above-mentioned embodiments etc., the unwanted object 9*b* adhering to the transfer belt 42 was detected while printing, this invention is not limited to this. Instead, for example, the unwanted object 9*b* adhering to the transfer belt 42 can be detected while carrying the recording medium 9 without performing printing.

Also, for example, although in the above-mentioned embodiments etc., this technology was applied to the image forming apparatuses of so-called the intermediate transfer system that performs the primary transfer and the secondary transfer, this invention is not limited to this. Instead, for example, this technology can be applied to an image forming apparatus of so-called the direct transfer system that transfers the toner image formed by the image forming unit to the recording medium. Below, an image forming apparatus of this modification is explained in detail.

Figure 14:
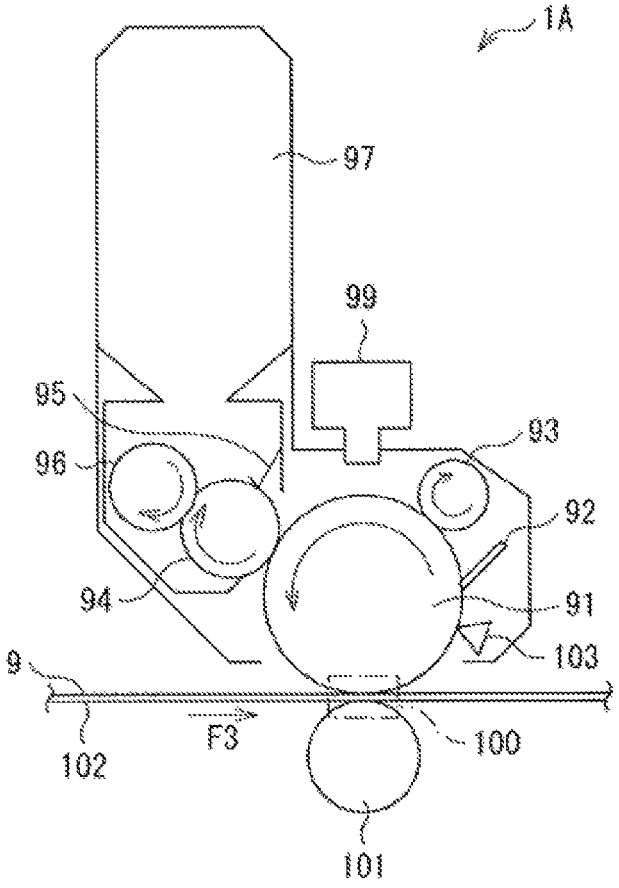
FIG. 14 is an explanatory diagram illustrating a configuration example of an image forming apparatus according to a modified embodiment.

Shown in FIG. 14 is the main part of an image forming apparatus 1A of this modification. The image forming apparatus 1A has a photosensitive body 91, a cleaning blade 92, a charging roller 93, a development roller 94, a development blade 95, a supply roller 96, a toner accommodation part 97, an exposure part 99, a transfer roller 101, a transfer belt 102, and a line sensor 103. The photosensitive body 91 and the transfer roller 101 configure a transfer part. The photosensitive body 91 rotates counterclockwise to carry a toner image toward a part where the photosensitive body 91 and the transfer roller 101 oppose each other (a nip section 100). A recording medium 9 is carried in a carrying direction F3 and is supplied to this nip section 100. Then, the toner image of the photosensitive body 91 is transferred to the recording medium 9. The line sensor 103 is disposed in the downstream side of the nip section 100 in the carrying path of the toner image carried by the photosensitive body 91 rotating, and images the photosensitive body 91. This image forming apparatus 1A detects whether an unwanted object (a label waste) has adhered to the photosensitive body 91 based on an image indicated by image data generated by an image processing part 52 and an image based on the imaging result by the line sensor 103. That is, this image forming apparatus 1A corresponds to the image forming apparatus 1 of the first embodiment mentioned above. Here, the photosensitive body 91 corresponds to a specific example of the "first carrying member" in this invention. The transfer roller 101 corresponds to a specific example of the "transfer member" in this invention. The line sensor 103 corresponds to a specific example of the "first detection part" in this invention.

Figure 15:
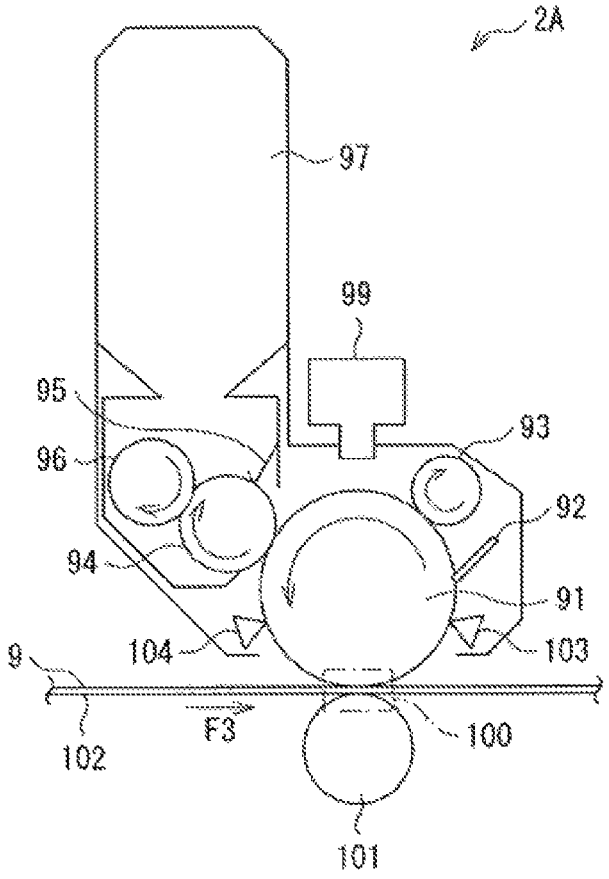
FIG. 15 is an explanatory diagram illustrating a configuration example of an image forming apparatus according to another modified embodiment.

Shown in FIG. 15 is the main part of an image forming apparatus 2A of this modification. The image forming apparatus 2A has a line sensor 104 in addition to a line sensor 103. The line sensor 104 is disposed in the upstream side of a nip section 100 in the carrying path of a toner image carried by a photosensitive body 91 rotating, and images the photosensitive body 91. This image forming apparatus 2A detects whether an unwanted object (a label waste) has adhered to the photosensitive body 91 based on an image based on the imaging result by the line sensor 104 and an image based on the imaging result by the line sensor 103. That is, this image forming apparatus 2A corresponds to the image forming apparatus 2 of the second embodiment mentioned above. Here, the line sensor 104 corresponds to a specific example of the "second detection part" in this invention.

In the specification, image P1, photographed images P11 and P14 are examples of a pre-transfer image. Photographed image P2 is an example of a post-transfer image. A designated printable region is embodied as a surface region of the carrying member (42, 91). When the apparatus executes an image forming process for a label, the designated printable region corresponds to an entire label. When it executes for a regular sheet such as letter, A4 or A3 size, the designated printable region corresponds to an entire one side surface of the sheet. The region may be determined as an entire surface of a sheet except for a margin surrounding its edges.

When one of the image forming units 30 functions to create the pre-transfer image (P1), it is defined that the image forming unit is disposed in the upstream side with respect to the nip section of the transfer member in the carrying path.

The region (W) may be defined as a development region where the developer (toner) is expected to adhere through the image forming process. The shape of the development region coincides to an outer peripheral of developer placed on the designated printable section.

What is claimed is:

1. An image forming apparatus, comprising:

a carrying part having a carrying member that holds a developer image and carries the developer image through a carrying operation along a carrying path for the developer image, a transfer member that is disposed opposing the carrying member in a prescribed position and transfers the developer image held by the carrying member to a recording medium, a development part that generates the developer image using a developer based on image data, the development part being disposed in an upstream side with respect to the prescribed position of the transfer member, a first detection part that is disposed in a downstream side with respect to the prescribed position of the transfer member in the carrying path of the developer image, which is carried by the carrying member, and detects an adhering object that adheres to the carrying member, generating a first detection result, and a control part that performs a carrying control in which the carrying operation of the developer image by the carrying member is controlled based on the first detection result by the first detection part and the image date, wherein based on a first image indicated by the image data, the control part obtains a processing target region of a second image generated using the first detection result in a carrying period during which the carrying member carries the developer image, and performs the carrying control based on pixel values in the processing target region.

2. The image forming apparatus according to claim 1, wherein the control part stops the carrying operation based on the first detection result.

3. The image forming apparatus according to claim 1, wherein the carrying member is a belt.

4. The image forming apparatus according to claim 1, wherein the carrying member is a photosensitive body.

5. The image forming apparatus according to claim 1, wherein the first detection part is a line sensor.

6. An image forming apparatus, comprising:

a carrying part having a carrying member that holds a developer image and carries the developer image through a carrying operation along a carrying path for the developer image, a transfer member that is disposed opposing the carrying member in a prescribed position and transfers the developer image held by the carrying member to a recording medium, a first detection part that is disposed in a downstream side with respect to the prescribed position of the transfer member in the carrying path of the developer image, which is carried by the carrying member, and detects an adhering object that adheres to the carrying member, generating a first detection result, a control part that performs a carrying control in which the carrying operation of the developer image by the carrying member is controlled based on the first detection result by the first detection part, and a second detection part that is disposed in an upstream side with respect to the prescribed position of the transfer member in the carrying path and detects an object adhering to the carrying member, generating a second detection result, wherein the control part performs the carrying control further based on the second detection result by the second detection part.

7. The image forming apparatus according to claim 6, wherein based on a first image, which is generated using the second detection result in a carrying period during which the carrying member carries the developer image, the control part obtains a processing target region of a second image generated using the first detection result in the carrying period, and performs the carrying control based on pixel values in the processing target region.

8. An image forming apparatus, comprising:

a carrying part having a carrying member that holds a developer image and carries the developer image through a carrying operation along a carrying path for the developer image, a transfer member that is disposed opposing the carrying member in a prescribed position and transfers the developer image held by the carrying member to a recording medium, a development part that generates the developer image using a developer based on image data, the development part being disposed in an upstream side with respect to the prescribed position of the transfer member, a first detection part that is disposed in a downstream side with respect to the prescribed position of the transfer member in the carrying path of the developer image, which is carried by the carrying member, and detects an adhering object that adheres to the carrying member, generating a first detection result, and a control part that performs a carrying control in which the carrying operation of the developer image by the carrying member is controlled based on the first detection result by the first detection part and the image data, wherein when the control part determines that the adhering object adhering to the carrying member, which is detected based on the first detection result, is not the developer, the control part stops the carrying operation.

9. The image forming apparatus according to claim 8, wherein when the control part determines that the adhering object is not the developer, the control part moves the carrying member and the transfer part far from each other.

10. The image forming apparatus according to claim 8, wherein the carrying part has a memory part, and is configured in a detachable manner, and when the control part determines that the adhering object is not the developer, the control part further stores alarm information in the memory part.

11. The image forming apparatus according to claim 10, wherein under a condition where the alarm information is stored in the memory part, when the control part detects that the adhering object other than the developer has been removed based on the first detection result by the first detection part, the control part deletes the alarm information in the memory part.

12. The image forming apparatus according to claim 10, further comprising:

a display part, wherein at a booting time of the image forming apparatus, and where the alarm information is stored in the memory part, the control part controls an operation of the display part so that the display part displays an error.

13. The image forming apparatus according to claim 12, wherein the booting time of the image forming apparatus includes one or both of a booting time for powering and a recovering from a sleep state.

14. The image forming apparatus according to claim 10, further comprising:

a display part, wherein when the carrying part is mounted to the image forming apparatus, and where the alarm information is stored in the memory part, the control part controls an operation of the display part so that the display part displays an error.

15. An image forming apparatus, comprising:

a development part that develops a latent image, which is created from image data to be printed on a recording medium, with a developer so that a development image is generated by the developer adhering to the latent image, a carrying part that has a carrying member of which an outer surface circulates along a carrying path to carry the developer image from the development part, the development image of the development part being designed to be placed within a designated printable section of the carrying member, a transfer member that is disposed opposing the carrying member and sandwiching the carrying path with the carrying member in a prescribed position such that a nip section is created between the transfer member and the carrying part at the prescribed position, and transfers the developer image held in the designated printable section of the carrying member to the recording medium that is conveyed along a medium conveyance path, a first detection part that is disposed in a downstream side with respect to the nip section of the transfer member in the carrying path, and obtains a post-transfer image of the designated printable section, the post-transfer image being composed with pixel values, a second detection part that is disposed in an upstream side with respect to the nip section of the transfer member in the carrying path, and obtains a pre-transfer image of the designated printable section, the pre-transfer image being composed with pixel values, a control part that controls a development operation of the development part and a carrying operation of the carrying part, wherein the control part determines a development region (W) of the pre-transfer image that is shaped in correspondence with an area where the developer is held on the carrying member, and the control part determines a processing target region of the post-transfer image that is calculated by deducting the development region of the pre-transfer image from the post-transfer image, a remaining region of the post-transfer image that is a remaining of the post-transfer image other than the processing target region, and the control part stops the carrying operation of the carrying part when a predetermined percentage of the processing target region has pixel values that differ by more than a predetermined threshold value from the remaining region.

16. The image forming apparatus according to claim 15, wherein the pre-transfer image is either the development image in the development part or a photographed image taken at a position along the carrying path between the nip section and the development part.

* * * * *